US012669128B2

(12) United States Patent
Kubota

(10) Patent No.: US 12,669,128 B2
(45) Date of Patent: Jun. 30, 2026

(54) PUMP UNIT, PUMP SYSTEM, AND PUMP SYSTEM OPERATION METHOD

(71) Applicant: NIKKISO CO., LTD., Tokyo (JP)

(72) Inventor: Yasushi Kubota, Tokyo (JP)

(73) Assignee: NIKKISO CO., LTD, Tokyo (JP)

( * ) Notice: Subject to any disclaimer, the term of this patent is extended or adjusted under 35 U.S.C. 154(b) by 0 days.

(21) Appl. No.: 19/108,939

(22) PCT Filed: Jul. 14, 2023

(86) PCT No.: PCT/JP2023/026022
§ 371 (c)(1),
(2) Date: Mar. 5, 2025

(87) PCT Pub. No.: WO2024/053249
PCT Pub. Date: Mar. 14, 2024

(65) Prior Publication Data

US 2026/0117782 A1 Apr. 30, 2026

(30) Foreign Application Priority Data

Sep. 7, 2022 (JP) ..... 2022-142393

(51) Int. Cl.
*F04D 25/06* (2006.01)
*F04D 1/04* (2006.01)
(Continued)

(52) U.S. Cl.
CPC ..... *F04D 25/06* (2013.01); *F04D 1/04* (2013.01); *F04D 7/02* (2013.01); *F04D 13/06* (2013.01);
(Continued)

(58) Field of Classification Search
CPC ... F04D 25/06; F04D 1/04; F04D 7/02; F04D 13/06; F04D 13/16; F04D 29/007;
(Continued)

(56) References Cited

U.S. PATENT DOCUMENTS 4,764,086 A 8/1988 Jesinger
2002/0114714 A1 8/2002 Sato
(Continued)

FOREIGN PATENT DOCUMENTS

CN 108512360 A 9/2018
FR 1427056 A 11/1968
(Continued)

OTHER PUBLICATIONS

PCT/JP2023/026022, International Search Report, Aug. 8, 2023.
PCT/JP2023/026022, Written Opinion, Aug. 8, 2023.
Extended Search Report 23862793.9 Nov. 5, 2025.

*Primary Examiner* — David N Brandt
(74) *Attorney, Agent, or Firm* — WCF IP

(57) ABSTRACT

A pump unit (2, 2A) is connected to a reservoir tank (T1) where liquid hydrogen and hydrogen gas generated by vaporization of the liquid hydrogen are stored and transfers the liquid hydrogen. The pump unit includes a rotation shaft (31), a motor (M) causing the shaft to rotate, an impeller (41) mounted on a front end (31*a*) of the shaft, a housing (30, 40) including a motor chamber (36) where the motor is accommodated and a pump chamber (43) where the impeller is accommodated, and a mechanical seal (42) mounted on the shaft and the housing and configured to seal the motor chamber with respect to the pump chamber. The motor includes a rotor (34) mounted on the shaft and a stator (35) that directly faces the rotor in a radial direction of the shaft and causes the rotor to rotate. The hydrogen gas is introduced into the motor chamber.

5 Claims, 9 Drawing Sheets

(51) Int. Cl.

| | |
|---|---|
| ***F04D 7/02*** | (2006.01) |
| ***F04D 13/06*** | (2006.01) |
| ***F04D 13/16*** | (2006.01) |
| ***F04D 29/00*** | (2006.01) |
| ***F04D 29/10*** | (2006.01) |
| ***F04D 29/12*** | (2006.01) |
| ***F04D 29/42*** | (2006.01) |
| ***F04D 29/58*** | (2006.01) |

(52) U.S. Cl.
CPC ..... *F04D 13/16* (2013.01); *F04D 29/007* (2013.01); *F04D 29/106* (2013.01); *F04D 29/126* (2013.01); *F04D 29/426* (2013.01); *F04D 29/5806* (2013.01)

(58) Field of Classification Search
CPC .... F04D 29/106; F04D 29/126; F04D 29/426; F04D 29/5806
See application file for complete search history.

(56) References Cited

U.S. PATENT DOCUMENTS

| | | | | |
|---|---|---|---|---|
| 2013/0343932 | A1 | 12/2013 | Stinessen | |
| 2016/0079822 | A1* | 3/2016 | Noguchi | F04D 13/06 310/71 |
| 2017/0122324 | A1* | 5/2017 | Meuter | F04D 7/06 |
| 2022/0186686 | A1* | 6/2022 | Honda | F04D 13/064 |
| 2022/0360143 | A1* | 11/2022 | Prat | A61M 16/12 |

FOREIGN PATENT DOCUMENTS

| | | | |
|---|---|---|---|
| JP | S47-23492 | B1 | 6/1972 |
| JP | S62-159795 | A | 7/1987 |
| JP | 2001-173598 | A | 6/2001 |
| JP | 2020-060103 | A | 4/2020 |
| JP | 2020-162275 | A | 10/2020 |

* cited by examiner

PUMP UNIT, PUMP SYSTEM, AND PUMP SYSTEM OPERATION METHOD

TECHNICAL FIELD

The present invention relates to a pump unit, a pump system, and an operation method of the pump system.

BACKGROUND ART

In recent years, hydrogen energy has been attracting attention as next-generation energy. Hydrogen can be converted into electrical power with a theoretically high degree of energy efficiency when used as fuel of a fuel cell, and may be a highly efficient clean energy source since harmful emissions are not produced. Hydrogen is stored as liquid hydrogen at hydrogen stations for fuel cell vehicles, for example.

When a centrifugal pump including a motor section and a pump section, which are separated with a mechanical seal, is used for transferring liquid hydrogen, a small amount of liquid hydrogen leaks from the mechanical seal. The leaked liquid hydrogen vaporizes and turns into hydrogen gas, and leaks to an external environment. Thus, a process of purging the hydrogen gas by means of helium gas is required, for example, but a running cost of the process is high and a system for the process is complicated. For such reason, a technique of transferring liquid hydrogen by using a leak-free canned motor pump has been proposed (for example, see PTL 1).

CITATION LIST

Patent Literature

[PTL 1] JP2020-162275 A

SUMMARY OF INVENTION

Technical Problem

Since liquid hydrogen has a small specific gravity of approximately 0.07, high-speed rotation of a rotor is necessary in order to gain a pressure required for transferring liquid hydrogen. In such a case, magnetic fluxes passing through a metallic can that liquid-seals the rotor changes at high speed, and a phenomenon (so-called "can loss") in which eddy current flows in the metallic can occurs. This phenomenon increases as a rotation frequency in a motor section (the rotor) increases. In addition, since the rotor rotates in a liquid, fluid friction loss on the rotor caused by the liquid increases as the rotation frequency in the motor section (the rotor) increases. Thus, the canned motor pump may not be suitable as a centrifugal pump for transferring liquid hydrogen with high-speed rotation.

By contrast, a pump including a motor section (rotor and stator) liquid-sealed together with pumped liquid is known as a leak-free centrifugal pump. In this pump, while the aforementioned phenomenon in which eddy current flows does not occur, fluid friction loss on the rotor caused by the liquid occurs. In a case of this pump and the canned motor pump, when a discharge flow rate is reduced, the temperature of discharged liquid is likely to rise significantly, and a two-phase flow in the liquid inside the pump section is likely to occur. In this pump and the canned motor pump, when the two-phase flow in the liquid inside the pump section occurs, the lubrication of a bearing for a rotation shaft of the rotor becomes unstable, an excitation force against the rotor caused by the fluid increases, and a life of the bearing is shortened. Thus, in this pump and the canned motor pump, the motor section needs to be always filled with the pumped liquid. However, a boiling point of liquid hydrogen is extremely low temperature, and in order to fill the motor section with liquid hydrogen, dedicated design and a certain level of flow rate are required.

The present invention is directed to providing a pump unit, a pump system, and an operation method of the pump system that are free from leaking of liquid hydrogen to an external environment and more suitable for high-speed rotation than a pump in which a rotor is liquid-sealed.

Solution to Problem

A pump unit in one aspect of the present invention is a pump unit that is connected to a reservoir tank in which liquid hydrogen and hydrogen gas generated by vaporization of the liquid hydrogen are stored and that transfers the liquid hydrogen, and the pump unit includes: a rotation shaft; a motor that causes the rotation shaft to rotate; an impeller mounted on one end of the rotation shaft in an axial direction of the rotation shaft; a housing including a motor chamber in which the motor is accommodated and a pump chamber in which the impeller is accommodated; and a mechanical seal that is mounted on the rotation shaft and the housing and seals the motor chamber with respect to the pump chamber, in which the motor includes a rotor mounted on the rotation shaft and a stator that directly faces the rotor in a radial direction of the rotation shaft and causes the rotor to rotate, and the hydrogen gas is introduced into the motor chamber.

A pump system in one aspect of the present invention is a pump system that is connected to a reservoir tank in which liquid hydrogen and hydrogen gas generated by vaporization of the liquid hydrogen are stored and that transfers the liquid hydrogen, and the pump system includes a pump unit that suctions and discharges the liquid hydrogen and a gas line connected to a gas-phase region of the reservoir tank where the hydrogen gas is stored, in which the pump unit includes: a rotation shaft; a motor that causes the rotation shaft to rotate; an impeller mounted on one end of the rotation shaft in an axial direction of the rotation shaft; a housing including a motor chamber in which the motor is accommodated and a pump chamber in which the impeller is accommodated; and a mechanical seal that is mounted on the rotation shaft and the housing and seals the motor chamber with respect to the pump chamber, the motor includes a rotor mounted on the rotation shaft and a stator that directly faces the rotor in a radial direction of the rotation shaft and causes the rotor to rotate, the housing includes a gas introduction port that opens toward the motor chamber and is connected to the gas line, and the hydrogen gas is introduced into the motor chamber through the gas line and the gas introduction port.

An operation method of a pump system in one aspect of the present invention is an operation method of a pump system that is connected to a reservoir tank in which liquid hydrogen and hydrogen gas generated by vaporization of the liquid hydrogen are stored and that transfers the liquid hydrogen, in which the pump system includes a pump unit that suctions and discharges the liquid hydrogen and a gas line connected to a gas-phase region of the reservoir tank where the hydrogen gas is stored, the pump unit includes: a rotation shaft; a motor that causes the rotation shaft to rotate; an impeller mounted on one end of the rotation shaft in an axial direction of the rotation shaft; a housing including a motor chamber in which the motor is accommodated and a pump chamber in which the impeller is accommodated; and a mechanical seal that is mounted on the rotation shaft and the housing and seals the motor chamber with respect to the pump chamber, and the motor includes a rotor mounted on the rotation shaft and a stator that directly faces the rotor in a radial direction of the rotation shaft and causes the rotor to rotate, the method including an advance preparation step of performing a preparation for enabling the pump unit to transfer liquid and a step of discharging the liquid hydrogen from the pump chamber, in which the advance preparation step includes a step of introducing the liquid hydrogen into the pump chamber and a step of introducing the hydrogen gas through the gas line into the motor chamber.

Advantageous Effects of Invention

The present invention is able to provide a pump unit, a pump system, and an operation method of the pump system that are free from leaking of liquid hydrogen and hydrogen gas to an external environment and more suitable for high-speed rotation than a pump in which a rotor is liquid-sealed.

DESCRIPTION OF EMBODIMENTS

Figure 1:
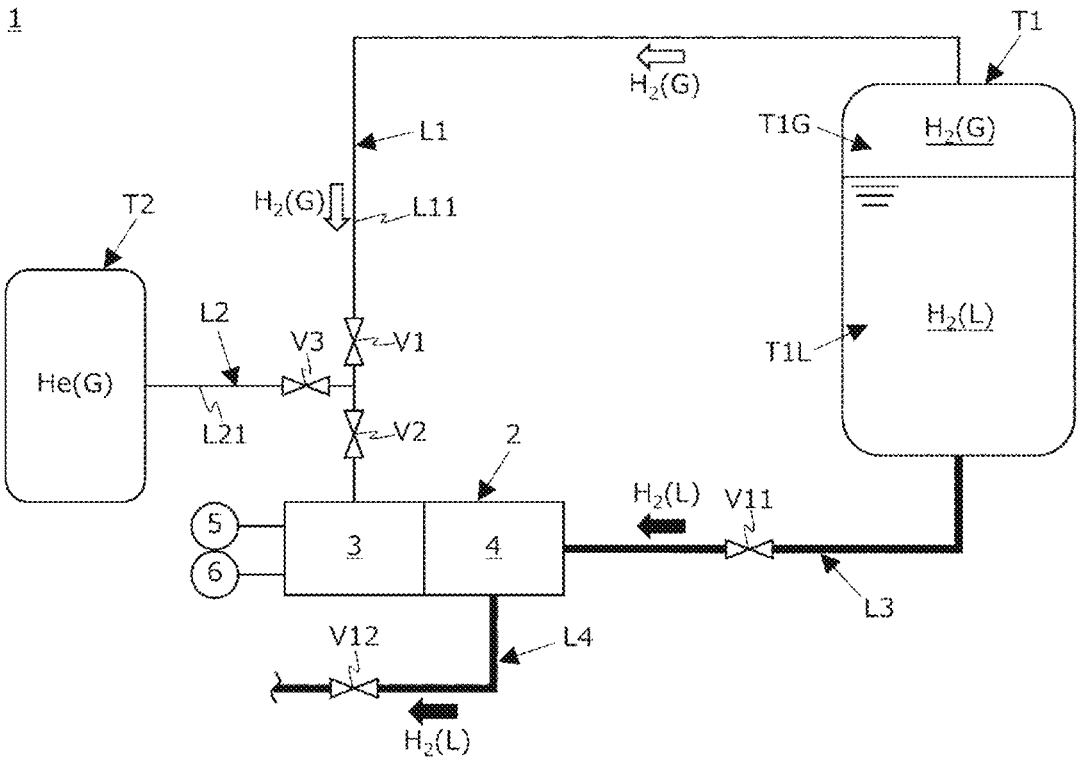
FIG. 1 is a schematic piping arrangement diagram illustrating a first embodiment of a pump system according to the present invention.

Embodiments of a pump unit, a pump system, and an operation method of the pump system according to the present invention will now be described below with reference to the drawings. In the drawings, the same members and components are indicated with the same reference signs, and repetitive description thereof will be omitted. The dimensional ratios of the components may be exaggerated for convenience of description and are not limited to the ratios illustrated in the drawings.

Pump System (1)

First, an embodiment of the pump system according to the present invention (hereinafter referred to as a "first embodiment") is described.

Configuration of Pump System (1)

FIG. 1 is a schematic piping arrangement diagram illustrating the first embodiment of the pump system according to the present invention.

The pump system 1 transfers liquid hydrogen $H_2$ (L). The pump system 1 includes a pump unit 2, a first reservoir tank T1, a second reservoir tank T2, a gas line L1, a purge gas line L2, a suction flow line L3, a suction valve V11, a discharge flow line LA, and a discharge valve V12.

The pump unit 2 is connected to the first reservoir tank T1 and transfers the liquid hydrogen $H_2$ (L) stored in the first reservoir tank T1. A configuration of the pump unit 2 will be described later.

The first reservoir tank T1 is, for example, a publicly known high pressure hydrogen tank that stores liquid hydrogen $H_2$ (L). The first reservoir tank T1 is an example of a reservoir tank in the present invention. Inside the first reservoir tank T1, a liquid-phase region T1L where liquid hydrogen $H_2$ (L) is stored and a gas-phase region T1G where hydrogen gas $H_2$ (G) generated by vaporization of the liquid hydrogen $H_2$ (L) is stored are present. The gas-phase region T1G is located above the liquid-phase region T1L.

In the pump system 1, the second reservoir tank T2 is, for example, a publicly known helium gas cylinder that stores helium gas He (G) functioning as a purge gas for hydrogen gas $H_2$ (G). The second reservoir tank T2 is an example of a purge gas tank in the present invention.

The gas line L1 is connected to the gas-phase region T1G and a motor chamber 36 to be described later, and serves as a line through which hydrogen gas $H_2$ (G) flows between the gas-phase region T1G and the motor chamber 36. The gas line L1 includes a pipe section L11, a first valve V1, and a second valve V2.

The pipe section L11 is a publicly known pipe connected to the gas-phase region T1G and the motor chamber 36 to be described later. The pipe section L11 is, for example, made of stainless steel, and has a publicly known heat-insulating structure (for example, a vacuum heat-insulating structure achieved by a double-layered structure).

The first valve V1 and the second valve V2 are publicly known valves (for example, gate valves) that are connected to the pipe section L11 and opens and closes the pipe section L11. The first valve V1 and the second valve V2 are, for example, made of stainless steel and have a publicly known heat-insulating structure (for example, a vacuum heat-insulating structure achieved by a double-layered structure). In the gas line L1, the second valve V2 is disposed downstream of the first valve V1 (on a side of the pump unit 2). The first valve V1 is an example of an open/close valve in the present invention.

The purge gas line L2 is a line that is connected to the second reservoir tank T2 and the gas line L1 and through which helium gas He (G) flows between the second reservoir tank T2 and the gas line L1. The purge gas line L2 includes a pipe section L21 and a third valve V3. A connecting point connecting the gas line L1 to the purge gas line L2 is located between the first valve V1 and the second valve V2 in the pipe section L11.

The pipe section L21 is a publicly known pipe connected to the second reservoir tank T2 and the gas line L1. The pipe section L21 is, for example, made of the same metal as the pipe section L11 and has the same heat-insulating structure as the pipe section L11.

The third valve V3 is a publicly known valve (for example, a gate valve) that is connected to the purge gas line L2 and opens and closes the purge gas line L2. The third valve V3 is, for example, made of the same metal as the first valve V1 and has the same heat-insulating structure as the first valve V1.

The suction flow line L3 is a publicly known pipe connected to the liquid-phase region T1L and a suction port 44*a* to be described later. The suction flow line L3 is, for example, made of stainless steel and has a publicly known heat-insulating structure (for example, a vacuum heat-insulating structure achieved by a double-layered structure).

The suction valve V11 is a publicly known valve (for example, a gate valve) that is connected to the suction flow line L3 and opens and closes the suction flow line L3. The suction valve V11 is, for example, made of stainless steel and has a publicly known heat-insulating structure (for example, a vacuum heat-insulating structure achieved by a double-layered structure).

The discharge flow line LA is a publicly known pipe connected to a discharge port 45*a* to be described later. The discharge flow line LA is, for example, made of the same metal as the suction flow line L3 and has the same heat-insulating structure as the suction flow line L3.

The discharge valve V12 is a publicly known valve (for example, a gate valve) that is connected to the discharge flow line L4 and opens and closes the discharge flow line L4. The discharge valve V12 is, for example, made of stainless steel and has a publicly known heat-insulating structure (for example, a vacuum heat-insulating structure achieved by a double-layered structure).

The pipe sections L11 and L21 are pipes through which associated gases (hydrogen gas $H_2$ (G) and helium gas He (G)) are passed to primarily establish an atmosphere filled with the associated gases inside the motor chamber 36 described later. Each of the pipe sections L11 and L21 is constructed of a relatively thin pipe (small-bore tube) depending on a capacity of the motor chamber 36. By contrast, the suction flow line L3 and the discharge flow line L4 are constructed of a relatively thick pipe (large-bore tube) depending on a flow rate that the pump unit 2 supports.

Noted that the heat-insulating structures of the pipes, the first to third valves V1 to V3, the suction valve V11, and the discharge valve V12 are a publicly known heat-insulating structure and not limited to those described in the present embodiment. In other words, the pump unit 2, the gas line L1, the purge gas line L2, the suction flow line L3, the suction valve V11, the discharge flow line LA, and the discharge valve V12 may be accommodated in a chamber and the chamber may be configured to be capable of maintaining an atmosphere inside the chamber to be a vacuum atmosphere.

Configuration of Pump Unit (1)

Figure 2:
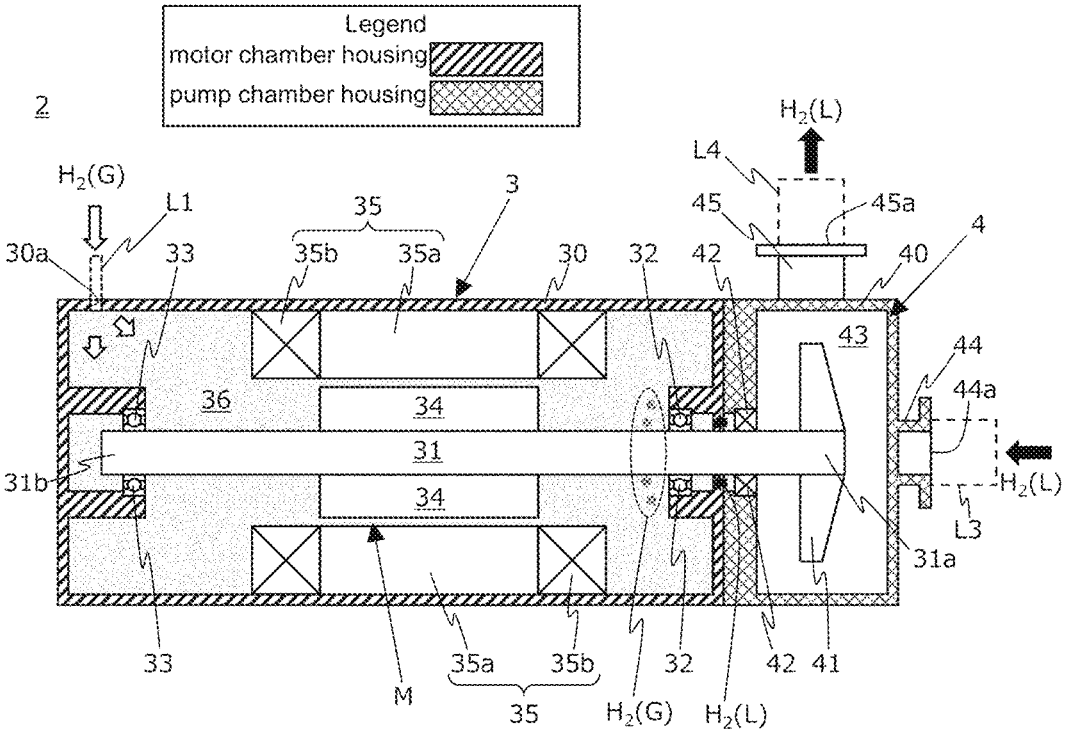
FIG. 2 is a schematic sectional view of a pump unit illustrating a first embodiment of the pump unit according to the present invention.

FIG. 2 is a schematic sectional view of the pump unit illustrating an embodiment (referred to as a "first embodiment" hereinafter) of the pump unit according to the present invention. This figure illustrates a flow of the hydrogen gas $H_2$ (G) introduced into the pump unit 2 with an open arrow and illustrates a flow of the liquid hydrogen $H_2$ (L) with a black arrow.

The pump unit 2 includes a motor section 3, a pump section 4, a temperature sensor 5, and a pressure sensor 6. Principal components of the pump unit 2 are mostly the same as those of a publicly known canned motor pump except that the pump unit 2 does not include a metallic can for sealing a rotor 34 to be described later and the pump unit 2 includes a mechanical seal 42 to be described later. Thus, in the following description, components of the motor section 3 and the pump section 4 are described focusing on points different from components of a publicly known canned motor pump, and detailed descriptions of components other than those are omitted.

In the following description, a "front direction" is a side on which the pump section 4 is located with respect to the motor section 3 and a "rear direction" is a side on which the motor section 3 is located with respect to the pump section 4. The motor section 3 is driven at a predetermined drive frequency with a predetermined driving voltage, and causes an impeller 41 to be described later to rotate. The motor section 3 includes a motor chamber housing 30, a rotation shaft 31, bearings 32 and 33, the rotor 34, a stator 35, and the motor chamber 36. The rotor 34 and the stator 35 constitute a motor M that is an example of the motor according to the present invention.

The motor chamber housing 30 defines the motor chamber 36 that accommodates the rotation shaft 31, the bearings 32 and 33, the rotor 34, and the stator 35. In other words, the motor chamber housing 30 contains the motor chamber 36. The motor chamber housing 30 includes a gas introduction port 30*a*. The motor chamber housing 30 is, for example, made of stainless steel.

The gas introduction port 30*a* is a through hole that penetrates the motor chamber housing 30. The gas introduction port 30*a* is, for example, located in a rear portion of the motor chamber housing 30 and opens toward the motor chamber 36. The gas introduction port 30*a* is connected to the gas line L1 (pipe section L11).

The rotation shaft 31 is rotated by rotation of the rotor 34 and transmits rotative power to the impeller 41 to be described later. The rotation shaft 31 has a cylindrical shape, for example. The rotation shaft 31 is placed through the rotor 34 and mounted to the rotor 34. In an axial direction of the rotation shaft 31, a front end 31*a* of the rotation shaft 31 protrudes into a pump chamber 43 to be described later. In the axial direction of the rotation shaft 31, the front end 31*a* of the rotation shaft 31 is an example of one end according to the present invention, and a rear end 31*b* is an example of an opposite end according the present invention.

The bearings 32 and 33 are mounted to the motor chamber housing 30 and the rotation shaft 31, and thus, rotatably support the rotation shaft 31. The bearing 32 is disposed in the front direction of the rotor 34, and the bearing 33 is disposed in the rear direction of the rotor 34. The bearings 32 and 33 are, for example, publicly known ball bearings.

The rotor 34 is rotated by a rotating magnetic field generated in the stator 35. The rotor 34 has a cylindrical shape. The rotor 34 is accommodated in the stator 35.

The stator 35 generates the rotating magnetic field that causes the rotor 34 to rotate. The stator 35 includes a cylindrical stator core 35*a* and a plurality of motor windings 35*b*. In a radial direction of the rotation shaft 31, an inner circumferential surface of the stator 35 directly faces an outer circumferential surface of the rotor 34. In other words, no structure (shielding object), such as a metallic can included in a publicly known canned motor pump, is disposed between the rotor 34 and the stator 35.

The pump section 4 suctions and discharges liquid hydrogen $H_2$ (L). The pump section 4 includes a pump chamber housing 40, the impeller 41, the mechanical seal 42, the pump chamber 43, a suction pipe 44, and a discharge pipe 45.

The pump chamber housing 40 defines the pump chamber 43 that accommodates the impeller 41 and the mechanical seal 42, and forms the suction pipe 44 serving as a flow line for liquid hydrogen $H_2$ (L) to be suctioned into the pump chamber 43 and the discharge pipe 45 serving as a flow line for liquid hydrogen $H_2$ (L) to be discharged from the pump chamber 43. In other words, the pump chamber housing 40 includes the pump chamber 43, the suction pipe 44, and the discharge pipe 45. The pump chamber 43 communicates with the suction pipe 44 and the discharge pipe 45. The suction pipe 44 includes the suction port 44*a* connected to the suction flow line L3. The discharge pipe 45 includes the discharge port 45*a* connected to the discharge flow line L4. The pump chamber housing 40 is made of the same metal as the motor chamber housing 30. The pump chamber housing 40 is disposed in the front direction of the motor chamber housing 30 and attached to the motor chamber housing 30. The pump chamber housing 40 together with the motor chamber housing 30 constitutes the housing according to the present invention.

The impeller 41 is mounted on the front end 31*a* of the rotation shaft 31 and accommodated in the pump chamber 43.

The mechanical seal 42 is mounted to the rotation shaft 31 and the pump chamber housing 40, and thus, seals the motor chamber 36 with respect to the pump chamber 43. In the axial direction of the rotation shaft 31, the mechanical seal 42 is disposed between the bearing 32 and the impeller 41. The mechanical seal 42 is, for example, a publicly known mechanical seal that includes a stationary ring (not illustrated) to be mounted to the pump chamber housing 40 and a rotary ring (not illustrated) to be mounted on the rotation shaft 31.

The temperature sensor 5 is attached to the motor section 3 and detects temperature in the motor chamber 36. The temperature sensor 5 is, for example, a publicly known temperature sensor capable of detecting up to ultralow temperature (for example, temperature of liquid hydrogen $H_2$ (L)).

The pressure sensor 6 is attached to the motor section 3 and detects pressure inside the motor chamber 36. The pressure sensor 6 is, for example, a publicly known pressure sensor.

Operations of Pump System (1)

Next, operations of the pump system 1, that is, the operation method of the pump system 1 according to the present invention is described. In the following description, FIG. 1 and FIG. 2 are referred to as appropriate.

Before starting an operation of the pump system 1 (before an operation of the pump unit 2), the first valve V1, the third valve V3, the suction valve V11, and the discharge valve V12 are closed. In addition, inside the gas line L1 downstream of the first valve V1, the motor chamber 36, the suction flow line L3 downstream of the suction valve V11 (on a side of the pump unit 2), the suction pipe 44, the pump chamber 43, the discharge pipe 45, and the discharge flow line LA upstream of the discharge valve V12 (on a side of the pump unit 2), a vacuum atmosphere is maintained, for example, by a vacuum pump (not illustrated, the same applies below) connected to the discharge flow line L4.

In the present invention, before the operation of the pump system 1 is started, the gas line L1 downstream of the first valve V1 and the motor chamber 36 may be filled with helium gas having a melting point lower than that of hydrogen.

First, a preparation for enabling the pump unit 2 to transfer liquid (an advance preparation step) is executed. In the advance preparation step, the discharge flow line L4 is disconnected from the vacuum pump first. Then, the suction valve V11 is opened, and liquid hydrogen $H_2$ (L) stored in the liquid-phase region T1L of the first reservoir tank T1 is introduced into the suction flow line L3, the suction pipe 44, the pump chamber 43, the discharge pipe 45, and the discharge flow line LA upstream of the discharge valve V12 (a liquid hydrogen introduction step). As a result, the suction flow line L3, the suction pipe 44, the pump chamber 43, the discharge pipe 45, and the discharge flow line LA upstream of the discharge valve V12 are filled with the liquid hydrogen $H_2$ (L). As a result, the suction flow line L3, the suction pipe 44, the pump chamber 43, the discharge pipe 45, and the discharge flow line LA upstream of the discharge valve V12 are cooled to the temperature of the liquid hydrogen $H_2$ (L) (a flow line precooling step).

Then, the first valve V1 and the second valve V2 are opened. In this state, the motor chamber 36 communicates with the gas-phase region T1G via the gas line L1 and the gas introduction port 30*a*, and the hydrogen gas $H_2$ (G) stored in the gas-phase region T1G is introduced into the motor chamber 36 through the gas line L1 and the gas introduction port 30*a* (a hydrogen gas introduction step). As a result, the motor chamber 36 is filled with the hydrogen gas $H_2$ (G), and the hydrogen gas $H_2$ (G) is cooled by the liquid hydrogen $H_2$ (L) in the pump chamber 43 via the rotation shaft 31 and the motor chamber housing 30 and the pump chamber housing 40. Eventually, the atmosphere inside the gas line L1 and the motor chamber 36 comes to equilibrium with an atmosphere inside the gas-phase region T1G. In other words, the gas line L1 and the motor chamber 36 are cooled by the hydrogen gas $H_2$ (G) to ultralow temperature, and have a stable hydrogen gas $H_2$ (G) atmosphere. In this case, as described above, before the hydrogen gas $H_2$ (G) is introduced, a vacuum atmosphere (or a helium gas atmosphere) is maintained inside the gas line L1 downstream of the first valve V1 and inside the motor chamber 36. Thus, in the gas line L1 and the motor chamber 36, no other gas component (for example, oxygen or nitrogen) that may be frozen with the introduced ultralow temperature hydrogen gas $H_2$ (G) exists, and no technical problem is generated due to freezing of the gas component (such as clogging in the pipe section L11 that is a small-bore tube or freezing of the bearings 32 and 33).

Note that, in the advance preparation step, the hydrogen gas introduction step may be executed concurrently with the liquid hydrogen introduction step, or may be executed before the liquid hydrogen introduction step. In the latter case, the hydrogen gas introduction step may be executed before the atmosphere inside the motor chamber 36 comes to equilibrium.

Then, the discharge valve V12 is opened, the pump unit 2 operates and the impeller 41 rotates, and thus, the liquid hydrogen $H_2$ (L) in the pump chamber 43 is discharged through the discharge pipe 45 to the discharge flow line L4. As a result, the inside of the discharge flow line L4 (mainly a portion downstream of the discharge valve V12) is cooled to the temperature of the liquid hydrogen $H_2$ (L) (a liquid-transferring flow line precooling step). In this state, transferring the liquid hydrogen $H_2$ (L) by the pump unit 2 becomes possible (each operation in the advance preparation step is completed). Then, transferring the liquid hydrogen $H_2$ (L) is started (a liquid hydrogen transferring step). In this state, the first valve V1 is closed and the motor chamber 36 is shut off from the gas-phase region T1G. As a result, the atmosphere inside the gas line L1 downstream of the first valve V1 and the motor chamber 36 is maintained in a predetermined hydrogen gas $H_2$ (G) atmosphere.

In this state, the bearings 32 and 33 are lubricated by the hydrogen gas $H_2$ (G). Note that kinematic viscosity of the hydrogen gas $H_2$ (G) is several times larger than that of the liquid hydrogen $H_2$ (L). Thus, the lubricating properties of the bearings 32 and 33 in the pump unit 2 where the hydrogen gas $H_2$ (G) is used are better than the lubricating properties in a case where liquid hydrogen $H_2$ (L) is used to lubricate the bearings 32 and 33.

As described above, since the first valve V1 is closed, the gas line L1 downstream of the first valve V1 and the motor chamber 36 constitute a closed space having a hydrogen gas $H_2$ (G) atmosphere (gas-phase space). Thus, the hydrogen gas $H_2$ (G) in the motor chamber 36 is cooled by the liquid hydrogen $H_2$ (L) flowing through the pump chamber 43 via the motor chamber housing 30 and the pump chamber housing 40 and the rotation shaft 31, and the hydrogen gas $H_2$ (G) atmosphere inside the motor chamber 36 comes to equilibrium in terms of heat and pressure. Heat generated locally in the motor chamber 36 (for example, in the bearings 32 and 33 or the motor M) is absorbed by the ultralow temperature hydrogen gas $H_2$ (G) in the motor chamber 36. Herein, the configurations of the gas line L1 and the motor chamber 36 (via the motor chamber housing 30) that constitute the gas-phase space are such that they can tolerate fluctuation of heat and fluctuation of pressure due to the heat that are expected when the pump unit 2 operates as usual. In addition, since the first valve V1 is closed, the heat absorbed by the hydrogen gas $H_2$ (G) in the motor chamber 36 is not transferred to the gas-phase region T1G.

As described above, the motor chamber 36 is filled not with the liquid hydrogen $H_2$ (L) that is a pumped liquid, but with the hydrogen gas $H_2$ (G). Thus, fluid friction loss that occurs on a liquid-sealed rotor in a conventional leak-free centrifugal pump (referred to as a "conventional pump" hereinafter) does not occur on the rotor 34. In addition, since a metallic can is not disposed between the rotor 34 and the stator 35, loss caused by eddy current that occurs in the conventional canned motor pump does not occurs in the pump unit 2, either. In other words, even though a rotation frequency of the rotor 34 is increased, fluid friction loss and loss caused by eddy current similar to those occurring in the conventional pump do not occur in the pump unit 2. Accordingly, an overall efficiency of the pump unit 2 improves further than that of the conventional pump, and the pump unit 2 is capable of adapting to high-speed rotation operations better than the conventional pump. In addition, even though the pump unit 2 operates with low-speed rotation, the atmosphere inside the motor chamber 36 is a hydrogen gas $H_2$ (G) atmosphere (single phase flow) and does not become a two-phase flow. Thus, the pump unit 2 is capable of adapting to low-speed rotation operations better than the conventional pump.

Furthermore, as described above, the motor chamber 36 is sealed with the mechanical seal 42 with respect to the pump chamber 43. Thus, as the rotation shaft 31 rotates, a small amount of the liquid hydrogen $H_2$ (L) may leak into the motor chamber 36 through the mechanical seal 42. The liquid hydrogen $H_2$ (L) that has leaked into the motor chamber 36 vaporizes and turns into hydrogen gas $H_2$ (G), and the hydrogen gas $H_2$ (G) diffuses in the hydrogen gas $H_2$ (G) with which the motor chamber 36 is filled (as depicted in FIG. 2 with gray arrows) and does not leak to an environment outside of the motor chamber 36, the gas line L1, and the gas-phase region T1G (in a case where the first valve V1 is opened). In other words, the pump system 1 as a whole achieves no leakage of liquid hydrogen $H_2$ (L) and hydrogen gas $H_2$ (G) even though the mechanical seal 42 is used.

Furthermore, as described above, the motor chamber 36 is filled not with the liquid hydrogen $H_2$ (L) that is a pumped liquid, but with the hydrogen gas $H_2$ (G). Thus, unlike the conventional pump, the motor section 3 does not need to be filled with the liquid hydrogen $H_2$ (L) when starting an operation of the pump system 1, and a process of vaporizing the liquid hydrogen $H_2$ (L) with which the motor section 3 is filled (a vaporization process) becomes unnecessary when ending the operation of the pump system 1. In other words, in the pump system 1, the liquid hydrogen $H_2$ (L) is introduced only into the pump chamber 43. Thus, unnecessary consumption of the liquid hydrogen $H_2$ (L) is reduced and thus, an operational cost of the pump system 1 can be reduced and energy conservation can be achieved.

In this manner, without leaking hydrogen (liquid hydrogen $H_2$ (L) and hydrogen gas $H_2$ (G)) to an external environment, the pump system 1 is capable of efficiently discharging the liquid hydrogen $H_2$ (L). While the pump system 1 is operating, conditions inside the motor chamber 36 (temperature and pressure) are detected by the temperature sensor 5 and the pressure sensor 6. Thus, an abnormal condition inside the motor chamber 36 may be constantly detected. Thus, even if a failure occurs in the mechanical seal 42 and a large amount of liquid hydrogen $H_2$ (L) leaks into the motor chamber 36, an abnormal condition inside the motor chamber 36 is detected, thereby enabling the pump system 1 to detect the failure of the mechanical seal 42.

Next, when the operation of the pump system 1 is stopped, an operation of the pump unit 2 is stopped first, and the suction valve V11 and the discharge valve V12 are closed. As a result, introduction of liquid hydrogen $H_2$ (L) into the pump chamber 43 and transferring the liquid hydrogen $H_2$ (L) with the pump unit 2 are stopped. Then, the third valve V3 is opened and helium gas He (G) from the second reservoir tank T2 is introduced into the gas line L1 downstream of the first valve V1 and the motor chamber 36. As a result, the hydrogen gas $H_2$ (G) in the gas line L1 and the motor chamber 36 is purged by the helium gas He (G). The purged gas is discharged, for example, through a discharge line (not illustrated) connected to the gas line L1. Thus, in a situation where the pump unit 2 is under maintenance or the like, the pump unit 2 can be safely dismounted and disassembled without leaking hydrogen gas $H_2$ (G) that is a combustible gas to an external environment. Then, the third valve V3 is closed, and inside the gas line L1 downstream of the first valve V1, the motor chamber 36, the suction flow line L3 downstream of the suction valve V11, the suction pipe 44, the pump chamber 43, the discharge pipe 45, and the discharge flow line L4 upstream of the discharge valve V12, a vacuum atmosphere is maintained by the vacuum pump.

In this way, when the first valve V1 is closed and the third valve V3 is opened, the purge gas (helium gas He (G)) is introduced into the motor chamber 36. When the first valve V1 is opened and the third valve V3 is closed, the hydrogen gas $H_2$ (G) is introduced into the motor chamber 36. In other words, the first valve V1 and the third valve V3 serve as a switching unit that switches gas to be introduced into the motor chamber 36 between the purge gas and the hydrogen gas $H_2$ (G).

Conclusion (1)

According to the embodiment described above, the pump unit 2 includes the rotation shaft 31, the motor M (the rotor 34 and the stator 35), the impeller 41, the motor chamber housing 30 and the pump chamber housing 40, and the mechanical seal 42. The motor M is accommodated in the motor chamber 36 and causes the rotation shaft 31 to rotate. The impeller 41 is mounted on the front end 31*a* of the rotation shaft 31 and accommodated in the pump chamber 43. The motor chamber housing 30 defines the motor chamber 36 and the pump chamber housing 40 defines the pump chamber 43. The mechanical seal 42 is mounted to the rotation shaft 31 and the pump chamber housing 40, and seals the motor chamber 36 with respect to the pump chamber 43. In the radial direction of the rotation shaft 31, the rotor 34 directly faces the stator 35. The liquid hydrogen $H_2$ (L) from the liquid-phase region T1L is introduced into the pump chamber 43 and the hydrogen gas $H_2$ (G) from the gas-phase region T1G is introduced into the motor chamber 36.

According to this configuration, while the pump unit 2 is operating, the motor chamber 36 is filled with the hydrogen gas $H_2$ (G) introduced from the gas-phase region T1G. Thus, the liquid hydrogen $H_2$ (L) that has leaked into the motor chamber 36 through the mechanical seal 42 vaporizes and diffuses in the hydrogen gas $H_2$ (G) in the motor chamber 36, and does not leak to an environment outside of the motor chamber 36. In other words, the pump unit 2 achieves no leakage of hydrogen (the liquid hydrogen $H_2$ (L) and the hydrogen gas $H_2$ (G)) even though the mechanical seal 42 is used. The bearings 32 and 33 are lubricated by the hydrogen gas $H_2$ (G) that has a larger kinematic viscosity than the liquid hydrogen $H_2$ (L). Heat generated locally in the motor chamber 36 is absorbed by the ultralow temperature hydrogen gas $H_2$ (G) in the motor chamber 36. In addition, the hydrogen gas $H_2$ (G) in the motor chamber 36 is cooled by the liquid hydrogen $H_2$ (L) in the pump chamber 43, and the hydrogen gas $H_2$ (G) atmosphere inside the motor chamber 36 comes to equilibrium in terms of heat and pressure. Fluid friction loss and loss caused by eddy current similar to those occurring in the conventional pump do not occur in the pump unit 2. Accordingly, an overall efficiency of the pump unit 2 improves further than that of the conventional pump, and the pump unit 2 is capable of adapting to operations varying from low-speed rotation to high-speed rotation better than the conventional pump. Unlike the conventional pump, when starting an operation of the pump unit 2, liquid hydrogen $H_2$ (L) is not introduced into the motor section 3. Thus, when the operation of the pump unit 2 ends, the vaporization process before discharging the liquid hydrogen $H_2$ (L) with which the motor section 3 is filled becomes unnecessary. Accordingly, unnecessary consumption of the liquid hydrogen $H_2$ (L) is reduced, an operational cost of the pump unit 2 can be reduced, and energy conservation can be achieved.

According to the embodiment described above, the pump system 1 includes the gas line L1 and the aforementioned pump unit 2. The gas line L1 is connected to the gas-phase region T1G of the first reservoir tank T1 where the hydrogen gas $H_2$ (G) is stored. The motor chamber housing 30 includes the gas introduction port 30*a* connected to the gas line L1. The hydrogen gas $H_2$ (G) from the gas-phase region T1G is introduced into the motor chamber 36 through the gas line L1 and the gas introduction port 30*a*. According to this configuration, while the pump system 1 is operating, the liquid hydrogen $H_2$ (L) that has leaked into the motor chamber 36 through the mechanical seal 42 vaporizes and diffuses in the hydrogen gas $H_2$ (G) in the motor chamber 36. Since the motor chamber 36 is connected to the gas-phase region T1G via the gas line L1, the hydrogen gas $H_2$ (G) does not leak to an environment outside of the pump system 1. In other words, the pump system 1 achieves no leakage of hydrogen (the liquid hydrogen $H_2$ (L) and the hydrogen gas $H_2$ (G)) even though the pump unit 2 including the mechanical seal 42 is used. In addition, since the pump system 1 includes the aforementioned pump unit 2, fluid friction loss and loss caused by eddy current, which are generated in the conventional pump, are not generated, and the pump system 1 is capable of adapting to operations from low-speed rotation to high-speed rotation.

According to the embodiment described above, the pump system 1 includes the purge gas line L2 connected to the gas line L1 and the second reservoir tank T2 in which the helium gas He (G) is stored, the helium gas being used for purging the hydrogen gas $H_2$ (G) introduced into the motor chamber 36. The purge gas line L2 includes the pipe section L21 and the third valve V3. The first valve V1 and the third valve V3 serve as the switching unit that switches the gas to be introduced into the motor chamber 36 between the purge gas and the hydrogen gas $H_2$ (G). According to this configuration, the first valve V1 closed and the third valve V3 opened, and thus the helium gas He (G) from the second reservoir tank T2 is introduced into the gas line L1 downstream of the first valve V1 and the motor chamber 36. As a result, the hydrogen gas $H_2$ (G) in the gas line L1 and the motor chamber 36 is purged by the helium gas He (G). Thus, in a situation where the pump unit 2 is under maintenance or the like, the pump unit 2 can be safely dismounted and disassembled without leaking the hydrogen gas $H_2$ (G) that is a combustible gas to an external environment.

According to the embodiment described above, the operation method of the pump system 1 includes the advance preparation step and the liquid hydrogen transferring step. The advance preparation step includes the liquid hydrogen introduction step, the flow line precooling step, the hydrogen gas introduction step, and the liquid-transferring flow line precooling step. According to this configuration, before the pump unit 2 starts transferring liquid hydrogen $H_2$ (L), the gas line L1 and the motor chamber 36 have an ultralow temperature hydrogen gas $H_2$ (G) atmosphere, and a flow line from the suction flow line L3 to the discharge flow line L4 is precooled by the liquid hydrogen $H_2$ (L). Accordingly, when the pump unit 2 starts transferring the liquid hydrogen $H_2$ (L), the hydrogen gas $H_2$ (G) atmosphere inside the motor chamber 36 is not abruptly changed, and the pump unit 2 is capable of stably transferring the liquid hydrogen $H_2$ (L).

Modification Example (1)

Next, a modification example of the pump system 1 is described below focusing on points different from the first embodiment described above. In the following description of the modification example, the same members and the members with a common function as in the first embodiment are indicated with the same reference signs as in the first embodiment for convenience of description. In the following modification example, FIG. 1 and FIG. 2 are referred to as appropriate.

First Modification Example

Figure 3:
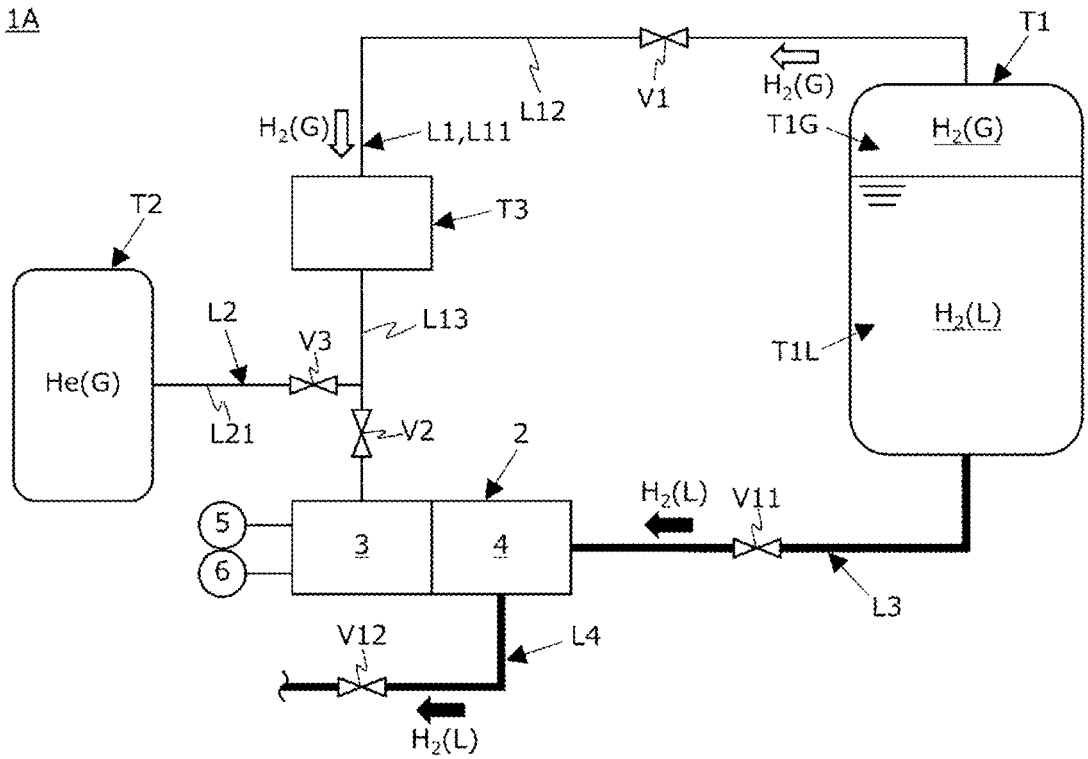
FIG. 3 is a schematic piping arrangement diagram illustrating a first modification example of the pump system illustrated in FIG. 1.

FIG. 3 is a schematic piping arrangement diagram illustrating a first modification example of the pump system of the first embodiment.

A pump system 1A includes the pump unit 2, the first reservoir tank T1, the second reservoir tank T2, the gas line L1, the purge gas line L2, the suction flow line L3, the suction valve V11, the discharge flow line LA, and the discharge valve V12. The gas line L1 includes the pipe section L11, the first valve V1, a buffer tank T3, and the second valve V2.

The pipe section L11 includes a first pipe section L12 and a second pipe section L13. The first pipe section L12 is a publicly known pipe connected to the gas-phase region T1G and the buffer tank T3. The second pipe section L13 is a publicly known pipe connected to the buffer tank T3 and the gas introduction port 30*a*. The first pipe section L12 is an example of a first gas line in the present invention while the second pipe section L13 is an example of a second gas line in the present invention.

The buffer tank T3 temporarily stores hydrogen gas $H_2$ (G) in the gas line L1. A design pressure (capacity) of the buffer tank T3 is set to a large value that enables the buffer tank T3 to absorb pressure fluctuation caused by temperature fluctuation in the gas line L1 downstream of the buffer tank T3 and the motor chamber 36. The buffer tank T3 is attached between the first valve V1 and the second valve V2 in the pipe section L11.

According to this configuration, even though pressure inside the motor chamber 36 fluctuates due to local heat in the motor chamber 36 while the pump system 1A is operating, the fluctuation is reduced by the hydrogen gas $H_2$ (G) stored in the buffer tank T3. As a result, while the pump system 1A is operating, when the first valve V1 is closed and the gas line L1 downstream of the first valve V1 and the motor chamber 36 constitute a closed space, the pressure inside the motor chamber 36 is stabilized. In addition, a capacity of the gas line L1 in the present modification example is larger than that of the gas line L1 in the first embodiment by the capacity of the buffer tank T3. Thus, even if temperature of the hydrogen gas $H_2$ (G) in the motor chamber 36 increases due to local heat in the motor chamber 36, the increase in temperature of the hydrogen gas $H_2$ (G) in the gas line L1 is reduced further than in the first embodiment. Accordingly, fluctuation of pressure and temperature in the motor chamber 36 is stabilized further than in the first embodiment. Thus, in the first modification example, when the first valve V1 is opened, the increase in temperature of the hydrogen gas $H_2$ (G) in the motor chamber 36 is not transferred to the gas-phase region T1G.

Second Modification Example

Figure 4:
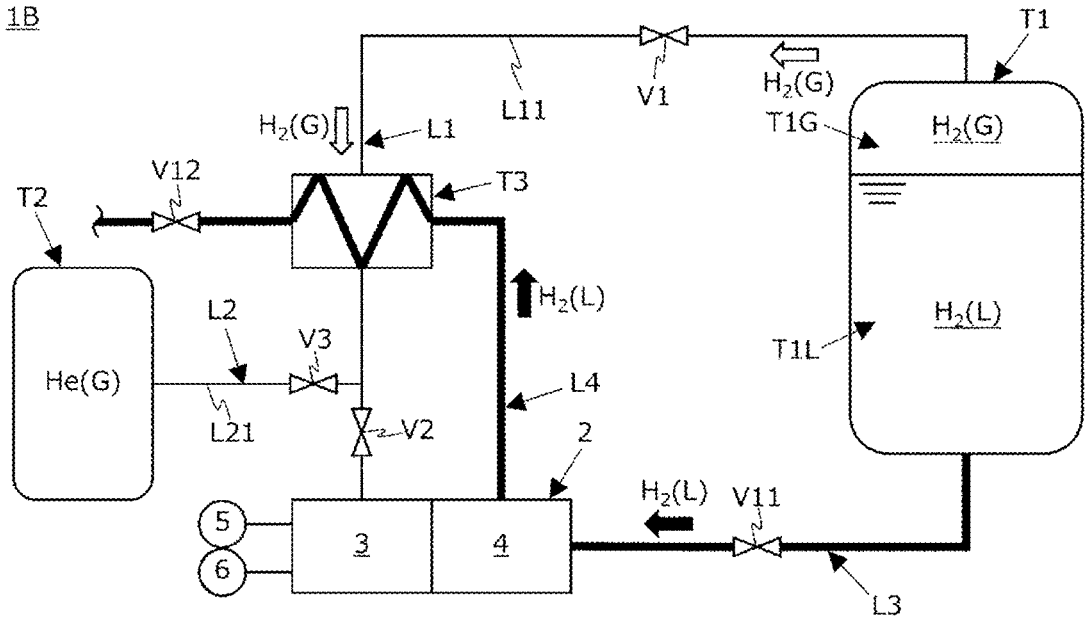
FIG. 4 is a schematic piping arrangement diagram illustrating a second modification example of the pump system illustrated in FIG. 1.

FIG. 4 is a schematic piping arrangement diagram illustrating a second modification example of the pump system of the first embodiment.

A pump system 1B includes the pump unit 2, the first reservoir tank T1, the second reservoir tank T2, the gas line L1, the purge gas line L2, the suction flow line L3, the suction valve V11, the discharge flow line LA, and the discharge valve V12. The gas line L1 includes the pipe section L11, the first valve V1, the buffer tank T3, and the second valve V2.

In the present modification example, a portion of the discharge flow line L4 is attached to the buffer tank T3 in such a way that heat exchange is performed between the liquid hydrogen $H_2$ (L) in the discharge flow line LA and the hydrogen gas $H_2$ (G) in the buffer tank T3. In other words, the portion of the discharge flow line L4 is attached to the buffer tank T3, for example, in such a way that the portion meanders in the buffer tank T3. As a result, the buffer tank T3 and the portion of the discharge flow line LA serve as a heat exchanger in which a liquid (the liquid hydrogen $H_2$ (L)) discharged from the pump unit 2 is used as coolant.

In this configuration, since the buffer tank T3 and the heat exchanger are integrally constructed, and the hydrogen gas $H_2$ (G) in the buffer tank T3 is always cooled while the pump unit 2 is operating. Thus, an effect of the buffer tank T3 in reducing pressure fluctuation improves further than in the first modification example. In addition, since the hydrogen gas $H_2$ (G) in the buffer tank T3 is cooled, the buffer tank T3 jointly defining a closed space with the motor chamber 36 and having a relatively large capacity, an efficiency of cooling the hydrogen gas $H_2$ (G) in the space is good, and increase in temperature and pressure in the gas line L1 and the motor chamber 36 is reduced. Furthermore, a separate heat exchanger is not required to be connected to the gas line L1, the number of connections that could be a cause of leaking of the hydrogen gas $H_2$ (G) is minimized, and conservation of space can be achieved.

In the present modification example, the buffer tank T3 does not have to serve as a heat exchanger and the pump system 1B may separately include a heat exchanger for performing heat exchange between the hydrogen gas $H_2$ (G) in the gas line L1 and the liquid hydrogen $H_2$ (L) in the discharge flow line L4. Even with this configuration, since the hydrogen gas $H_2$ (G) in the gas line L1 is always cooled, the increase in temperature and pressure in the motor chamber 36 is reduced further than in the first modification example.

Pump System (2)

Next, an another embodiment of the pump system (referred to as a "second embodiment" hereinafter) is described below focusing on points different from the first embodiment, the first modification example, and the second modification example. In the following description of the second embodiment, the same members and the members with a common function as in the first embodiment, the first modification example, and the second modification example are indicated with the same reference signs as in the first embodiment, the first modification example, and the second modification example for convenience of description. In the following description, FIG. 1 and FIG. 2 are referred to as appropriate.

Configuration of Pump System (2)

Figure 5:
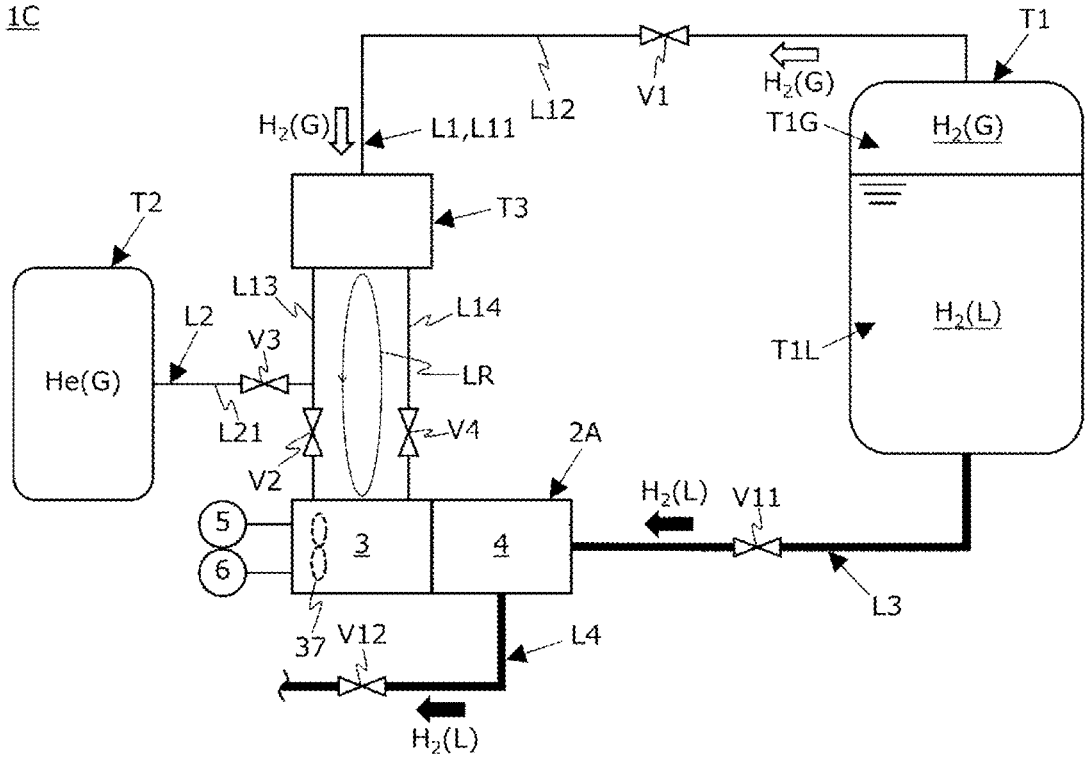
FIG. 5 is a schematic piping arrangement diagram illustrating a second embodiment of the pump system according to the present invention.

FIG. 5 is a schematic piping arrangement diagram illustrating the second embodiment of the pump system.

The pump system 1C transfers liquid hydrogen $H_2$ (L). The pump system 1C includes a pump unit 2A, the first reservoir tank T1, the second reservoir tank T2, the gas line L1, the purge gas line L2, the suction flow line L3, the suction valve V11, the discharge flow line L4, and the discharge valve V12.

The pump unit 2A is connected to the first reservoir tank T1 and transfers the liquid hydrogen $H_2$ (L) stored in the first reservoir tank T1. A configuration of the pump unit 2A will be described later.

The gas line L1 includes the pipe section L11, the first valve V1, the second valve V2, a fourth valve V4, and the buffer tank T3.

The pipe section L11 includes the first pipe section L12, the second pipe section L13, and a third pipe section L14. The third pipe section L14 is a publicly known pipe connected to the buffer tank T3 and a gas discharge port 30*b* to be described later. The third pipe section L14 is an example of a third gas line in the present invention.

The fourth valve V4 is a publicly known valve (for example, a gate valve) that is connected to the third pipe section L14 and opens and closes the third pipe section L14. The fourth valve V4 is, for example, made of the same metal as the first valve V1, and has the same heat-insulating structure as the first valve V1.

Configuration of Pump Unit (2)

Figure 6:
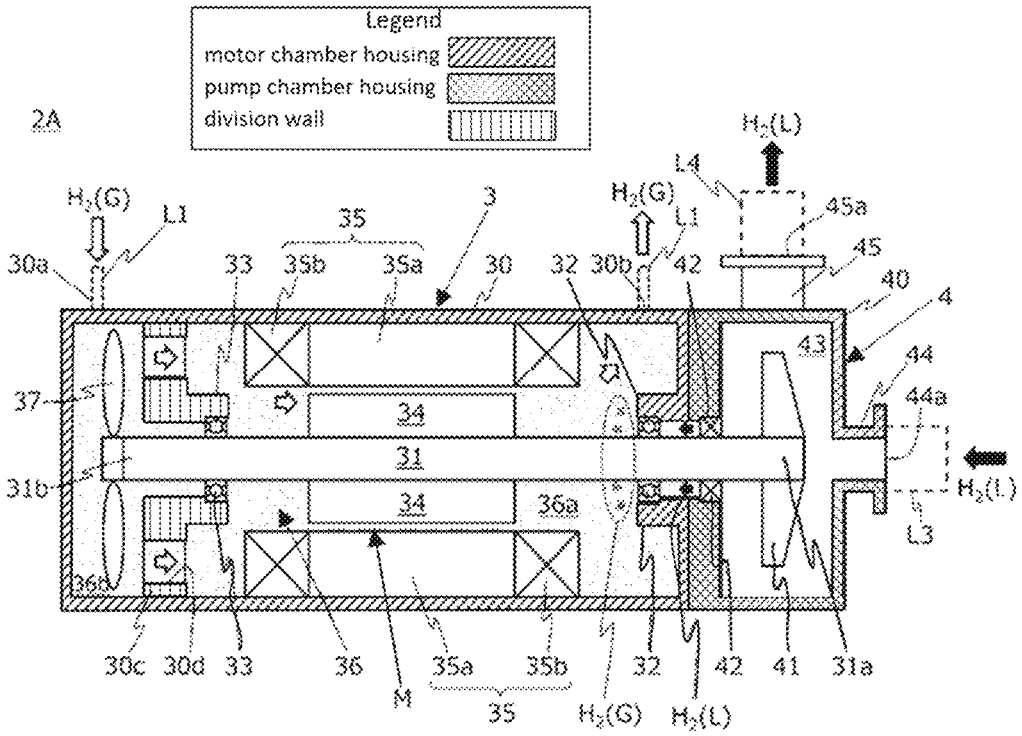
FIG. 6 is a schematic sectional view of the pump unit illustrating a second embodiment of the pump unit according to the present invention.

FIG. 6 is a schematic sectional view of the pump unit illustrating an another embodiment (referred to as a "second embodiment" hereinafter) of the pump unit according to the present invention (that is, the pump unit 2A).

The pump unit 2A includes the motor section 3, the pump section 4, the temperature sensor 5, and the pressure sensor 6. The configuration of the pump unit 2A is the same as that of the pump unit 2 of the first embodiment except that the motor section 3 includes a fan 37, the gas discharge port 30*b*, and a division wall 30*c* that are described later.

The motor section 3 includes the motor chamber housing 30, the rotation shaft 31, two bearings 32 and 33, the rotor 34, the stator 35, the motor chamber 36, and the fan 37.

The motor chamber housing 30 includes the gas introduction port 30*a*, the gas discharge port 30*b*, and the division wall 30*c*.

The gas introduction port 30*a* is, for example, located in the rear portion of the motor chamber housing 30 and opens toward a second motor chamber 36*b* to be described later. The gas introduction port 30*a* is connected to the gas line L1 (second pipe section L13). In the axial direction of the rotation shaft 31, the gas introduction port 30*a* is located in the rear direction relative to the motor M (on a side of the rear end 31*b* of the rotation shaft 31).

The gas discharge port 30*b* is a through hole that penetrates the motor chamber housing 30. The gas discharge port 30*b* is, for example, located in a front section of the motor chamber housing 30 and opens toward a first motor chamber 36*a* to be described later. The gas discharge port 30*b* is connected to the gas line L1 (third pipe section L14). In the axial direction of the rotation shaft 31, the gas introduction port 30*a* is located in the front direction of the motor M (on a side of the front end 31*a* of the rotation shaft 31).

The division wall 30*c* partitions the motor chamber 36 into the first motor chamber 36*a* in which the motor M is accommodated and the second motor chamber 36*b* in which the fan 37 is accommodated. The first motor chamber 36*a* is located in the front direction of the second motor chamber 36*b*. The division wall 30*c* includes a plurality of ventilating holes 30*d* that penetrate the division wall 30*c* in a front-rear direction and cause the first motor chamber 36*a* to communicate with the second motor chamber 36*b*.

The fan 37 causes the hydrogen gas $H_2$ (G) in the motor chamber 36 to flow and thus, causes the hydrogen gas $H_2$ (G) to circulate between the gas line L1 and the motor chamber 36. The fan 37 is, for example, made of stainless steel. The fan 37 is mounted on the rear end 31*b* of the rotation shaft 31 that protrudes into the second motor chamber 36*b* and accommodated in the second motor chamber 36*b*. In other words, the fan 37 is disposed in the motor chamber 36. The fan 37 is configured to rotate in conjunction with the rotation shaft 31 and cause the hydrogen gas $H_2$ (G) to flow forward.

Operations of Pump System (2)

Next, operations of the pump system 1C, that is, the operation method of the pump system 1C according to the present invention is described. In the following description, FIG. 1, FIG. 2, FIG. 5, and FIG. 6 are referred to as appropriate.

Before starting an operation of the pump system 1C (before an operation of the pump unit 2A), the first valve V1, the third valve V3, the suction valve V11, and the discharge valve V12 are closed. Inside the gas line L1 downstream of the first valve V1, the motor chamber 36, the suction flow line L3 downstream of the suction valve V11, the suction pipe 44, the pump chamber 43, the discharge pipe 45, and the discharge flow line L4 upstream of the discharge valve V12, a vacuum atmosphere is maintained, for example, by the aforementioned vacuum pump.

First, the liquid hydrogen introduction step and the flow line precooling step of the advance preparation step are executed, similarly to the first embodiment.

Then, the first valve V1, the second valve V2, and the fourth valve V4 are opened. With this operation, the motor chamber 36 communicates with the gas-phase region T1G via the gas line L1, and the hydrogen gas $H_2$ (G) stored in the gas-phase region T1G is introduced into the motor chamber 36 through the gas line L1 (the hydrogen gas introduction step). As a result, the motor chamber 36 is filled with the hydrogen gas $H_2$ (G), and the atmosphere inside the gas line L1 and the motor chamber 36 eventually comes to equilibrium with the atmosphere inside the gas-phase region T1G. In other words, the gas line L1 and the motor chamber 36 are cooled by the hydrogen gas $H_2$ (G) to ultralow temperature, and have a stable hydrogen gas $H_2$ (G) atmosphere.

Then, the discharge valve V12 is opened, the pump unit 2A operates and the impeller 41 rotates, and thus, the liquid hydrogen $H_2$ (L) in the pump chamber 43 is discharged through the discharge pipe 45 to the discharge flow line L4. As a result, the inside of the discharge flow line L4 (mainly a portion downstream of the discharge valve V12) is cooled to the temperature of the liquid hydrogen $H_2$ (L) (the liquid-transferring flow line precooling step). At the same time, the fan 37 rotates in conjunction with the rotation of the rotation shaft 31, causing the hydrogen gas $H_2$ (G) in the second motor chamber 36*b* to flow into the first motor chamber 36*a*. As a result, in the motor chamber 36, the hydrogen gas $H_2$ (G) introduced through the gas introduction port 30*a* into the second motor chamber 36*b* is caused to flow from the rear to the front and flow out through the gas discharge port 30*b* into the third pipe section L14, and thus, the hydrogen gas $H_2$ (G) is caused to return to the buffer tank T3 from the motor chamber 36 (a circulation initiation step). In this state, transferring the liquid hydrogen $H_2$ (L) by the pump unit 2A becomes possible (each operation in the advance preparation step is completed). Then, transferring the liquid hydrogen $H_2$ (L) is started (the liquid hydrogen transferring step). In this state, the first valve V1 is closed and the motor chamber 36 is shut off from the gas-phase region T1G. As a result, the atmosphere inside the gas line L1 downstream of the first valve V1 and the motor chamber 36 is maintained in a predetermined hydrogen gas $H_2$ (G) atmosphere.

In this state, since the first valve V1 is closed, the gas line L1 downstream of the first valve V1 and the motor chamber 36 constitute a closed space having a hydrogen gas $H_2$ (G) atmosphere (gas-phase space). In addition, the buffer tank T3, the second pipe section L13, the gas introduction port 30*a*, the second motor chamber 36*b*, the ventilating holes 30*d*, the first motor chamber 36*a*, the gas discharge port 30*b*, and the third pipe section L14 constitute a circulation line LR in which hydrogen gas $H_2$ (G) circulates. As described above, the hydrogen gas $H_2$ (G) in the circulation line LR is circulated by the fan 37. In this configuration, the hydrogen gas $H_2$ (G) in the motor chamber 36 is cooled by the liquid hydrogen $H_2$ (L) in the pump chamber 43 via the motor chamber housing 30 and the pump chamber housing 40 and the rotation shaft 31 and circulates in the circulation line LR, and thus, the hydrogen gas $H_2$ (G) atmosphere inside the circulation line LR comes to equilibrium in terms of heat and pressure. Thus, the temperature in the motor chamber 36 is maintained at a temperature lower than that in the motor chamber 36 in the first embodiment. In addition, since wind from the fan 37 directly blows against the motor M, the motor M is cooled further than that in the first embodiment.

In the second embodiment, the pump system 1C has the common configuration to the pump system 1 of the first embodiment and the pump system 1A of the first modification example of the first embodiment. Thus, the effect obtained with the pump system 1 and the pump system 1A is similarly obtained with the pump system 1C.

Conclusion (2)

According to the embodiment described above, the pump system 1C has the common configuration to the pump system 1 of the first embodiment and includes the fan 37 that causes the hydrogen gas $H_2$ (G) to circulate between the motor chamber 36 and the buffer tank T3. The motor chamber housing 30 includes the gas discharge port 30*b* through which the hydrogen gas $H_2$ (G) introduced into the motor chamber 36 is discharged to the gas line L1. The gas line L1 includes the third pipe section L14 connected to the gas discharge port 30*b* and the buffer tank T3. According to this configuration, the hydrogen gas $H_2$ (G) introduced through the gas introduction port 30*a* into the motor chamber 36 is discharged by an operation of the fan 37 through the gas discharge port 30*b* to the third pipe section L14, caused to return to the buffer tank T3, and introduced into the motor chamber 36 again through the second pipe section L13 and the gas introduction port 30*a*. As a result, the hydrogen gas $H_2$ (G) in the motor chamber 36 is cooled by the liquid hydrogen $H_2$ (L) in the pump chamber 43 and circulates between the motor chamber 36 and the buffer tank T3 without remaining in the motor chamber 36. Accordingly, the hydrogen gas $H_2$ (G) atmosphere inside the motor chamber 36 and the buffer tank T3 comes to equilibrium in terms of heat and pressure further than that in the first embodiment, and the temperature in the motor chamber 36 is maintained at a temperature lower than that in the first embodiment.

According to the embodiment described above, the fan 37 is mounted on the rotation shaft 31 and causes the hydrogen gas $H_2$ (G) introduced through the gas introduction port 30*a* to flow toward the gas discharge port 30*b*. According to this configuration, a special mechanism for accommodating and rotating the fan 37 is not required, thereby facilitating flow of the hydrogen gas $H_2$ (G) in the motor chamber 36.

According to the embodiment described above, in the axial direction of the rotation shaft 31, the fan 37 is mounted on the rear end 31*b* of the rotation shaft 31. The motor chamber housing 30 includes the division wall 30*c* that separates the first motor chamber 36*a* in which the motor M is accommodated from the second motor chamber 36*b* in which the fan 37 is accommodated. The division wall 30*c* includes the ventilating holes 30*d* that cause the first motor chamber 36*a* to communicate with the second motor chamber 36*b*. The gas introduction port 30*a* opens toward the second motor chamber 36*b*. The gas discharge port 30*b* opens toward the first motor chamber 36*a* and is located on the side of the front end 31*a* with respect to the motor M in the axial direction of the rotation shaft 31. According to this configuration, the buffer tank T3, the second pipe section L13, the gas introduction port 30*a*, the second motor chamber 36*b*, the ventilating holes 30*d*, the first motor chamber 36*a*, the gas discharge port 30*b*, and the third pipe section L14 constitute the circulation line LR in which the hydrogen gas $H_2$ (G) circulates. The hydrogen gas $H_2$ (G) in the motor chamber 36 is cooled by the liquid hydrogen $H_2$ (L) in the pump chamber 43 and circulates in the circulation line LR, and thus, the atmosphere inside the circulation line LR comes to equilibrium in terms of heat and pressure. Thus, the temperature in the motor chamber 36 is maintained at a temperature lower than that in the first embodiment. In addition, since wind from the fan 37 directly blows against the motor M, the motor M is cooled further than that in the first embodiment.

According to the embodiment described above, the operation method of the pump system 1C includes the advance preparation step and the liquid hydrogen transferring step. The advance preparation step includes the liquid hydrogen introduction step, the flow line precooling step, the hydrogen gas introduction step, the liquid-transferring flow line precooling step, and the circulation initiation step. According to this configuration, before the pump unit 2A starts transferring liquid hydrogen $H_2$ (L), the gas line L1 and the motor chamber 36 have an ultralow temperature hydrogen gas $H_2$ (G) atmosphere, and the flow line from the suction flow line L3 to the discharge flow line LA is precooled by the liquid hydrogen $H_2$ (L). In addition, the temperature in the motor chamber 36 is maintained at a temperature lower than that in the motor chamber 36 in the first embodiment. Accordingly, when the pump unit 2A starts transferring the liquid hydrogen $H_2$ (L), the hydrogen gas $H_2$ (G) atmosphere inside the motor chamber 36 is not abruptly changed, and the pump unit 2A is capable of stably transferring the liquid hydrogen $H_2$ (L).

In the second embodiment, a location of the fan 37 is not limited to the side of the rear end 31*b* of the rotation shaft 31. In other words, the fan 37 may be disposed, for example, on the side of the front end 31*a* in the motor chamber 36 (for example, between the motor M and the bearing 32 in the axial direction of the rotation shaft 31). In addition, the fan 37 may be mounted, for example, not on the rotation shaft 31, but on a fan rotation shaft dedicated for the fan 37 (not illustrated). Furthermore, the fan 37 may be, for example, provided in the gas line L1 and connected to the second pipe section L13 or the third pipe section L14.

In the second embodiment, the motor chamber housing 30 does not have to include the division wall 30*c*.

In the second embodiment, positions of the gas introduction port 30*a* and the gas discharge port 30*b* may be a position that allows the hydrogen gas $H_2$ (G) to circulate between the motor chamber 36 and the buffer tank T3, and the positions are not limited to those described in the second embodiment.

In the second embodiment, the pump system 1C does not have to include the buffer tank T3.

Modification Example (2)

Next, a modification example of the pump system 1C is described below focusing on points different from the second embodiment described above. In the following modification example, the same members and the members with a common function as in the second embodiment are indicated with the same reference signs as in the second embodiment for convenience of description. In the following modification example, FIG. 1, FIG. 2, FIG. 5, and FIG. 6 are referred to as appropriate.

First Modification Example

Figure 7:
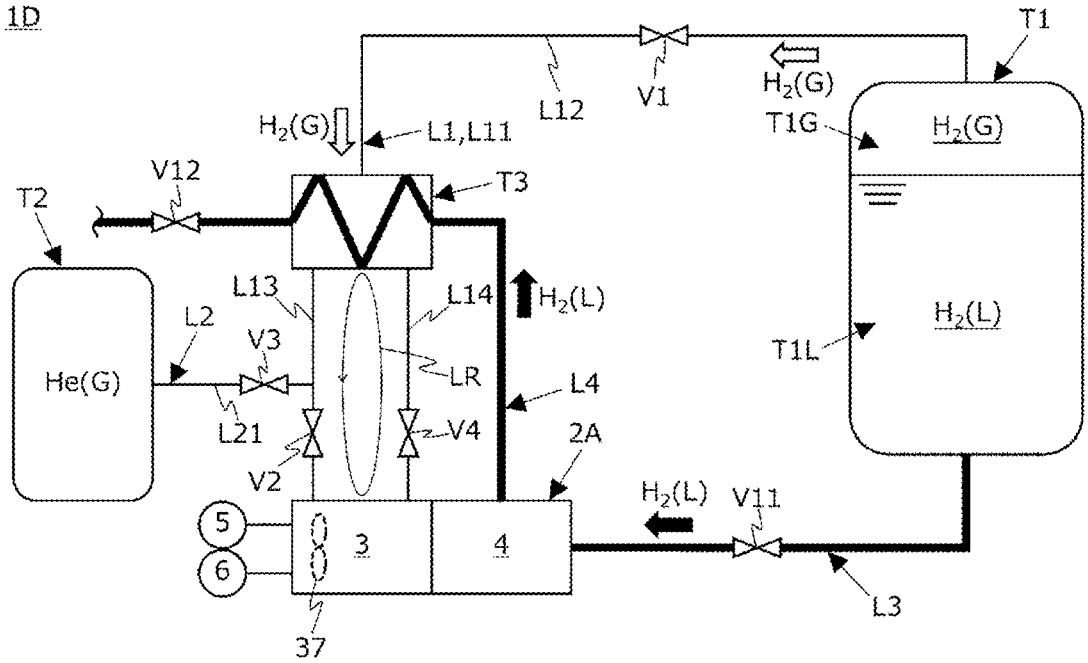
FIG. 7 is a schematic piping arrangement diagram illustrating a first modification example of the pump system illustrated in FIG. 5.

FIG. 7 is a schematic piping arrangement diagram illustrating a first modification example of the pump system of the second embodiment.

The pump system 1D includes the pump unit 2A, the first reservoir tank T1, the second reservoir tank T2, the gas line L1, the purge gas line L2, the suction flow line L3, the suction valve V11, the discharge flow line L4, and the discharge valve V12.

In the present modification example, a portion of the discharge flow line LA is attached to the buffer tank T3 in such a way that heat exchange is performed between the liquid hydrogen $H_2$ (L) in the discharge flow line L4 and the hydrogen gas $H_2$ (G) in the buffer tank T3. As a result, the buffer tank T3 and the portion of the discharge flow line L4 serve as a heat exchanger in which a liquid (the liquid hydrogen $H_2$ (L)) discharged from the pump unit 2A is used as coolant.

In this configuration, the hydrogen gas $H_2$ (G) in the buffer tank T3 is always cooled while the pump unit 2A is operating. Thus, the effect of the buffer tank T3 in reducing pressure fluctuation improves further than that in the second embodiment. In addition, since the hydrogen gas $H_2$ (G) in the buffer tank T3 jointly constituting the closed circulation line LR with the motor chamber 36 is cooled, the increase in temperature and pressure in the motor chamber 36 is further reduced.

Second Modification Example

Figure 8:
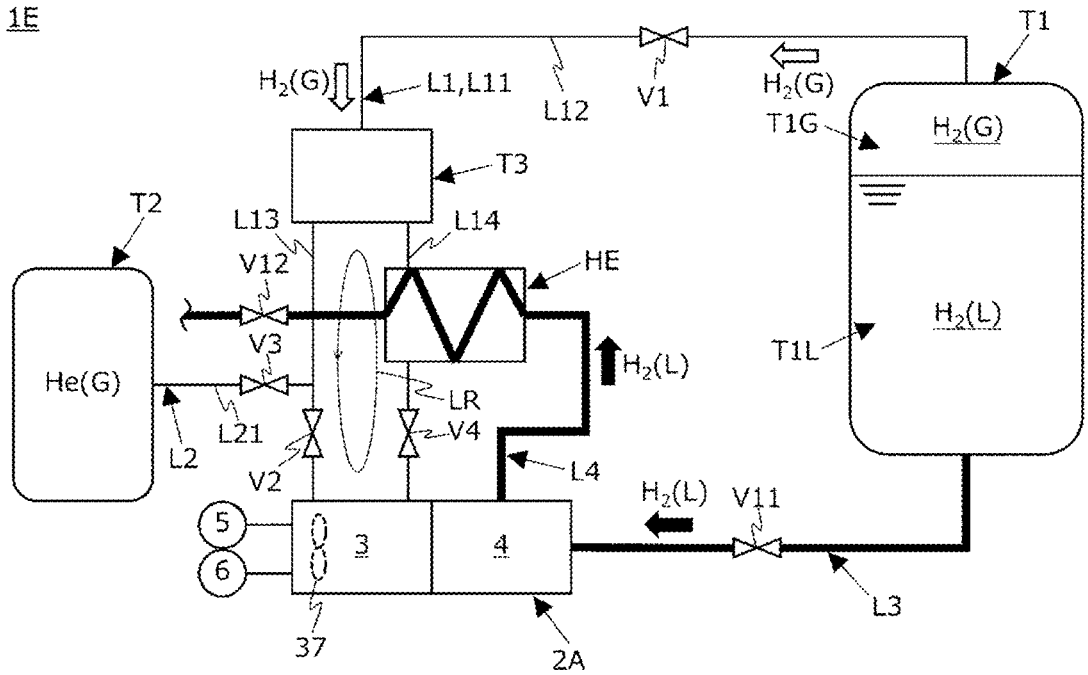
FIG. 8 is a schematic piping arrangement diagram illustrating a second modification example of the pump system illustrated in FIG. 5.

FIG. 8 is a schematic piping arrangement diagram illustrating a second modification example of the pump system of the second embodiment.

A pump system 1E includes the pump unit 2A, the first reservoir tank T1, the second reservoir tank T2, the gas line L1, the purge gas line L2, the suction flow line L3, the suction valve V11, the discharge flow line LA, the discharge valve V12, and a heat exchanger HE.

The heat exchanger HE is attached to the third pipe section L14 and the discharge flow line L4, and performs heat exchange between the hydrogen gas $H_2$ (G) in the third pipe section L14 and the liquid hydrogen $H_2$ (L) in the discharge flow line LA. In other words, the heat exchanger HE cools the hydrogen gas $H_2$ (G) in the third pipe section L14 by using a liquid (the liquid hydrogen $H_2$ (L)) discharged from the pump unit 2A as coolant.

In this configuration, the hydrogen gas $H_2$ (G) in the third pipe section L14 to which the heat exchanger HE is attached is always cooled while the pump unit 2A is operating, and delivered to the buffer tank T3. In other words, the hydrogen gas $H_2$ (G) that is returned from the motor chamber 36 to the buffer tank T3 is always cooled. Thus, an effect equivalent to that of the buffer tank T3 in the first modification example of the second embodiment in reducing pressure fluctuation can be obtained. In addition, since the hydrogen gas $H_2$ (G) in the third pipe section L14 jointly constituting the closed circulation line LR with the motor chamber 36 is cooled, the increase in temperature and pressure in the motor chamber 36 is reduced similarly to the first modification example of the second embodiment.

In the present modification example, the heat exchanger HE may be attached to the second pipe section L13.

Third Modification Example

Figure 9:
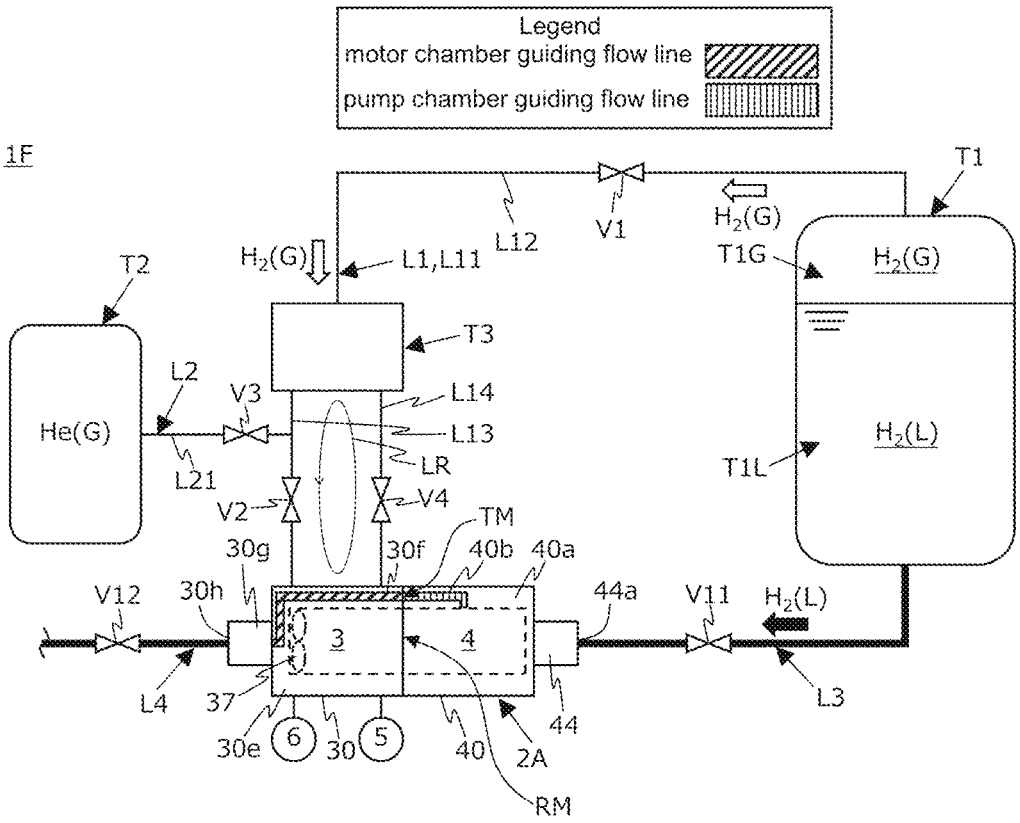
FIG. 9 is a schematic piping arrangement diagram illustrating a third modification example of the pump system illustrated in FIG. 5.

FIG. 9 is a schematic piping arrangement diagram illustrating a third modification example of the pump system of the second embodiment.

The pump system 1F includes the pump unit 2A, the first reservoir tank T1, the second reservoir tank T2, the gas line L1, the purge gas line L2, the suction flow line L3, the suction valve V11, the discharge flow line L4, and the discharge valve V12.

The motor chamber housing 30 includes the gas introduction port 30*a*, the gas discharge port 30*b*, the division wall 30*c*, a motor chamber outer wall 30*e*, and a motor chamber guiding flow line 30*f*.

The motor chamber outer wall 30*e* is an outer shell of the motor chamber housing 30 that defines the motor chamber 36. A portion of the motor chamber outer wall 30*e* has a hollow double-layered structure and constitutes the motor chamber guiding flow line 30*f*. In other words, the motor chamber guiding flow line 30*f* is disposed in the motor chamber outer wall 30*e*. In addition, a portion of the motor chamber outer wall 30*e* protrudes outward and constitutes a motor chamber discharge pipe 30*g*. In other words, in the third modification example, the motor chamber discharge pipe 30*g* and a discharge port 30*h* are disposed on a side of the motor section 3. The motor chamber discharge pipe 30*g* communicates with the guiding flow line 30*f*. TM labels the junction between the pump chamber guiding flow line 40*b* and the motor chamber guiding flow line 30*f*. This junction is aligned in FIG. 9 with the RM which denotes the abutment of the pump chamber outer wall 40*a* and the motor chamber outer wall 30*e*.

The suction pipe 44 and the suction port 44*a* are disposed on a side of the pump section 4 similarly to the first embodiment. The pump chamber housing 40 includes a pump chamber outer wall 40*a*, and a pump chamber guiding flow line 40*b*.

The pump chamber outer wall 40*a* is an outer shell of the pump chamber housing 40 that defines the pump chamber 43. A portion of the pump chamber outer wall 40*a* has a hollow double-layered structure and constitutes the pump chamber guiding flow line 40*b*. In other words, the pump chamber guiding flow line 40*b* is disposed in the pump chamber outer wall 40*a*. The pump chamber guiding flow line 40*b* communicates with the pump chamber 43 and the motor chamber guiding flow line 30*f*. Accordingly, the liquid hydrogen $H_2$ (L) in the pump chamber 43 is transferred through the pump chamber guiding flow line 40*b*, the motor chamber guiding flow line 30*f*, the motor chamber discharge pipe 30*g*, and the discharge port 30*h* to the discharge flow line L4.

A portion of the third pipe section L14 on an upstream side (on a side of the gas discharge port 30*b*) is attached to the motor chamber housing 30 and the pump chamber housing 40 in such a way that heat exchange may be performed between the hydrogen gas $H_2$ (G) in the third pipe section L14 and the liquid hydrogen $H_2$ (L) in the motor chamber guiding flow line 30*f* and the pump chamber guiding flow line 40*b*. In other words, the portion of the third pipe section L14 is disposed, for example, in such a way that the portion meanders in the guiding flow 30*f* and 40*b*. As a result, the motor chamber housing 30 and the pump chamber housing 40 and the portion of the third pipe section L14 (gas line L1) serve as a heat exchanger in which the liquid hydrogen $H_2$ (L) before being discharged from the pump unit 2A is used as coolant. The portion of the third pipe section L14 (gas line L1) is an example of a heat exchange line in the present invention.

In this configuration, the hydrogen gas $H_2$ (G) in the third pipe section L14 is always cooled while the pump unit 2A is operating similarly to the second modification example of the second embodiment, and delivered to the buffer tank T3. In other words, the hydrogen gas $H_2$ (G) that is returned from the motor chamber 36 to the buffer tank T3 is always cooled. Thus, an effect equivalent to that of the buffer tank T3 in the first modification example of the second embodiment in reducing pressure fluctuation can be obtained. In addition, since the hydrogen gas $H_2$ (G) in the third pipe section L14 jointly constituting the closed circulation line LR with the motor chamber 36 is cooled, the increase in temperature and pressure in the motor chamber 36 is reduced similarly to the first modification example of the second embodiment. Furthermore, since the pump unit 2A also serves as the heat exchanger, separate connection and piping for the heat exchanger are not required.

In the present modification example, the portion of the third pipe section L14 on the upstream side (on the side of the gas discharge port 30*b*) may be attached to the motor chamber housing 30 and the pump chamber housing 40 in such a way that heat exchange may be performed between the hydrogen gas $H_2$ (G) in the third pipe section L14 and the liquid hydrogen $H_2$ (L) in the motor chamber guiding flow line 30*f* and the pump chamber guiding flow line 40*b*, and does not have to be disposed in the motor chamber guiding flow line 30*f* and the pump chamber guiding flow line 40*b*. In other words, the portion of the third pipe section L14 on the upstream side (on the side of the gas discharge port 30*b*) may be, for example, attached to external surfaces of the motor chamber outer wall 30*e* and pump chamber outer wall 40*a* constituting the motor chamber guiding flow line 30*f* in series with the pump chamber guiding flow line 40*b*.

In the present modification example, the gas line L1 may be configured to perform heat exchange between the hydrogen gas $H_2$ (G) and the liquid hydrogen $H_2$ (L) at a different position other than the motor chamber guiding flow line 30*f* and the pump chamber guiding flow line 40*b*. In other words, in the present modification example, heat exchange between the hydrogen gas $H_2$ (G) and the liquid hydrogen $H_2$ (L) may be performed, for example, in the buffer tank T3 or the heat exchanger HE similarly to the first modification example or the second modification example of the second embodiment. In this case, the motor chamber guiding flow line 30*f* and the pump chamber guiding flow line 40*b* are used for cooling of the motor chamber housing 30 (the hydrogen gas $H_2$ (G) in the motor chamber 36).

Other Embodiments

In the first embodiment and the second embodiment, the pump system (1, 1C) may include the pump unit (2, 2A) and the gas line L1, and the configuration of the pump system (1, 1C) is not limited to those described in the first embodiment and the second embodiment. In other words, the pump system according to the present invention does not have to include, for example, the first reservoir tank T1, the second reservoir tank T2, the purge gas line L2, the suction flow line L3, and/or the discharge flow line LA, and may be connected to equipment including these elements.

In the first embodiment and the second embodiment, the pump system (1, 1C) may include a vacuum pump and a discharge line, which are connected to the gas line L1.

In the modification examples, the buffer tank T3 and the heat exchanger HE, each of which serves as a heat exchanger, may be configured to be capable of performing heat exchange between the hydrogen gas $H_2$ (G) in the gas line L1 and the liquid hydrogen $H_2$ (L) in the discharge flow line LA, and the configurations thereof are not limited to those in the modification examples.

In the first embodiment and the second embodiment, the pump unit 2, 2A may include an inducer disposed on a side of the suction port 44*a* with respect to the impeller 41.

In the first embodiment and the second embodiment, the first valve V1 may be opened or closed while the pump unit 2 is operating based on the conditions (temperature and pressure) in the motor chamber 36. In other words, for example, when temperature (or pressure) in the motor chamber 36 increases, the first valve V1 is opened, and when temperature (or pressure) in the motor chamber 36 decreases, the first valve V1 is closed.

In the first embodiment and the second embodiment, the motor M may be a permanent magnet DC motor in which the rotor 34 includes a permanent magnet. In this case, the pump unit (2, 2A) includes a protector (for example, a protector made of stainless steel) that covers the rotor 34 and isolates the rotor 34 from hydrogen gas $H_2$ (G). In this configuration, embrittlement of the permanent magnet caused by the hydrogen gas $H_2$ (G) is prevented.

In the first embodiment, the second embodiment, and modification examples, the pipe bodies and valves may have a configuration that allows the hydrogen gas $H_2$ (G) from the gas-phase region T1G to be introduced into the motor chamber 36 and the liquid hydrogen $H_2$ (L) from the liquid-phase region T1L to be introduced into the pump chamber 43, and the configurations are not limited to those described in the first embodiment, the second embodiment, and modification examples.

The configurations in the first embodiment, the second embodiment, and modification examples may be combined with one another.

Aspects of the Present Invention

Next, aspects of the present invention conceived from the embodiments described above will be described below with reference to the terms and reference signs described in the embodiments.

A first aspect of the present invention is a pump unit (for example, the pump unit 2, 2A) that is connected to a reservoir tank (for example, the first reservoir tank T1) in which liquid hydrogen (for example, the liquid hydrogen $H_2$ (L)) and hydrogen gas (for example, the hydrogen gas $H_2$ (G)) generated by vaporization of the liquid hydrogen are stored and that transfers the liquid hydrogen, and the pump unit includes: a rotation shaft (for example, the rotation shaft 31); a motor (for example, the motor M) that causes the rotation shaft to rotate; an impeller (for example, the impeller 41) mounted on one end (for example, the front end 31*a*) of the rotation shaft in an axial direction of the rotation shaft; a housing (for example, the motor chamber housing 30, and the pump chamber housing 40) including a motor chamber (for example, the motor chamber 36) in which the motor is accommodated and a pump chamber (for example, the pump chamber 43) in which the impeller is accommodated; and a mechanical seal (for example, the mechanical seal 42) that is mounted on the rotation shaft and the housing and seals the motor chamber with respect to the pump chamber, in which the motor includes a rotor (for example, the rotor 34) mounted on the rotation shaft and a stator (for example, the stator 35) that directly faces the rotor in a radial direction of the rotation shaft and causes the rotor to rotate, and the hydrogen gas is introduced into the motor chamber.

According to this configuration, the pump unit achieves no leakage of hydrogen (liquid hydrogen and hydrogen gas) even though the mechanical seal is used, and is capable of adapting to operations varying from low-speed rotation to high-speed rotation.

A second aspect of the present invention is the pump unit in the first aspect, in which the housing includes a gas introduction port (for example, the gas introduction port 30*a*) that is connected to a gas line (for example, the gas line L1) connected to a gas-phase region (for example, the gas-phase region T1G) of the reservoir tank where the hydrogen gas is stored, and the hydrogen gas is introduced into the motor chamber through the gas introduction port.

According to this configuration, since the motor chamber is connected to the gas-phase region via the gas line, the hydrogen gas does not leak to an environment outside of the pump system.

A third aspect of the present invention is the pump unit in the second aspect (for example, the pump unit 2A), in which the housing includes: outer wall structures that separate the pump chamber and the motor chamber from an environment outside the housing (for example, the motor chamber outer wall 30*e*, and the pump chamber outer wall 40*a*); a suction port (for example, the suction port 44*a*) that is disposed on a side of the pump chamber of the housing and through which the liquid hydrogen from the reservoir tank is suctioned into the pump chamber; a discharge port (for example, the discharge port 45*a*) that is disposed on a side of the motor chamber of the housing and through which the liquid hydrogen from the pump chamber is discharged; and a guiding flow line (for example, the motor chamber guiding flow line 30*f* that is disposed in the motor chamber outer wall 30*e* in series with the pump chamber guiding flow line 40*b* that is disposed in the pump chamber outer wall 40*a*) and through which the liquid hydrogen from the pump chamber is guided to the discharge port.

According to this configuration, the housing (the hydrogen gas in the motor chamber) is cooled by the liquid hydrogen that is guided through the guiding flow line.

A fourth aspect of the present invention is the pump unit in the third aspect, further including a heat exchange line that constitutes a portion of the gas line, in which the heat exchange line is disposed in such a way as to enable heat exchange between the hydrogen gas in the heat exchange line and the liquid hydrogen in the guiding flow line.

According to this configuration, the hydrogen gas in a third pipe section is always cooled while the pump unit is operating, and delivered to a buffer tank. Thus, an effect of the buffer tank in reducing pressure fluctuation improves.

A fifth aspect of the present invention is the pump unit in any one of the second aspect to the fourth aspect, further including a fan (for example, the fan 37) disposed in the motor chamber, in which the housing includes a gas discharge port (for example, the gas discharge port 30*b*) through which the hydrogen gas introduced into the motor chamber is discharged to the gas line, and the fan causes the hydrogen gas introduced through the gas introduction port into the motor chamber to flow toward the gas discharge port.

According to this configuration, the hydrogen gas in the motor chamber is cooled by the liquid hydrogen in the pump chamber and circulates without remaining in the motor chamber. As a result, the atmosphere of the hydrogen gas in the motor chamber and the buffer tank comes to equilibrium in terms of heat and pressure, and temperature in the motor chamber is maintained at a low temperature.

A sixth aspect of the present invention is the pump unit in the first aspect, in which the motor is a permanent magnet DC motor in which the rotor (for example, the rotor 34) includes a permanent magnet, and the pump unit includes a protector that covers the rotor and isolates the rotor from the hydrogen gas.

According to this configuration, embrittlement of the permanent magnet caused by the hydrogen gas is prevented.

A seventh aspect of the present invention is a pump system (for example, the pump system 1, 1A, 1B, 1C, 1D, 1E, 1F) that is connected to a reservoir tank (for example, the first reservoir tank T1) in which liquid hydrogen (for example, the liquid hydrogen $H_2$ (L)) and hydrogen gas (for example, the hydrogen gas $H_2$ (G)) generated by vaporization of the liquid hydrogen are stored and that transfers the liquid hydrogen, and the pump system includes a pump unit (for example, the pump unit 2, 2A) that suctions and discharges the liquid hydrogen, and a gas line (for example, the gas line L1) connected to a gas-phase region (for example, the gas-phase region T1G) of the reservoir tank where the hydrogen gas is stored, in which the pump unit includes: a rotation shaft (for example, the rotation shaft 31); a motor (for example, the motor M) that causes the rotation shaft to rotate; an impeller (for example, the impeller 41) mounted on one end (for example, the front end 31*a*) of the rotation shaft in an axial direction of the rotation shaft; a housing (for example, the motor chamber housing 30, and the pump chamber housing 40) including a motor chamber (for example, the motor chamber 36) in which the motor is accommodated and a pump chamber (for example, the pump chamber 43) in which the impeller is accommodated; and a mechanical seal (for example, the mechanical seal 42) that is mounted on the rotation shaft and the housing and seals the motor chamber with respect to the pump chamber, the motor includes a rotor (for example, the rotor 34) mounted on the rotation shaft and a stator (for example, the stator 35) that directly faces the rotor in a radial direction of the rotation shaft and causes the rotor to rotate, the housing includes a gas introduction port (for example, the gas introduction port 30*a*) that is connected to the gas line, and the hydrogen gas is introduced into the motor chamber through the gas line and the gas introduction port.

According to this configuration, the pump system achieves no leakage of hydrogen even though the pump unit including the mechanical seal is used, and is capable of adapting to transferring the liquid hydrogen from low-speed rotation to high-speed rotation.

An eighth aspect of the present invention is the pump system in the seventh aspect (for example, the pump system 1A, 1B, 1C, 1D, 1E, 1F), in which the gas line includes: a buffer tank (for example, the buffer tank T3) that temporarily stores the hydrogen gas; a first gas line (for example, the first pipe section L12) connected to the buffer tank and the gas-phase region; a second gas line (for example, the second pipe section L13) connected to the buffer tank and the gas introduction port; and an open/close valve (for example, the first valve V1) that is connected to the first gas line and opens and closes the first gas line.

According to this configuration, even though pressure inside the motor chamber fluctuates due to local heat caused by a bearing or the stator while the pump system is operating, the fluctuation is reduced by the hydrogen gas stored in the buffer tank. Even though the temperature of the hydrogen gas in the motor chamber increases due to local heat, increase in temperature of the hydrogen gas in the gas line and the motor chamber is reduced.

A ninth aspect of the present invention is the pump system in the eighth aspect (for example, the pump system 1B, 1D, 1E, 1F), further including: a discharge flow line (for example, the discharge flow line L4) connected to a discharge port (for example, the discharge port 45*a*) included in the housing and through which the liquid hydrogen from the pump chamber is discharged; and a heat exchanger (for example, the buffer tank T3 or the heat exchanger HE) that enables heat exchange between the hydrogen gas in the gas line and the liquid hydrogen in the discharge flow line.

According to this configuration, even though temperature of the hydrogen gas in the motor chamber increases due to local heat, increase in temperature of the hydrogen gas in the gas line and the motor chamber is reduced.

A tenth aspect of the present invention is the pump system of the ninth aspect (for example, the pump system 1B, 1D), in which the discharge flow line is disposed in such a way as to enable heat exchange between the liquid hydrogen flowing through the discharge flow line and the hydrogen gas in the buffer tank, and the buffer tank serves as the heat exchanger.

According to this configuration, the hydrogen gas in the buffer tank is always cooled while the pump unit is operating. As a result, increase in temperature and pressure in the gas line and the motor chamber is further reduced.

An eleventh aspect of the present invention is the pump system in the seventh aspect (for example, the pump system 1F), in which the housing includes: an outer wall (for example, the motor chamber outer wall 30*e*, pump chamber outer wall 40*a*) that defines each of the pump chamber and the motor chamber; a suction port (for example, a suction port 44*a*) that is disposed on a side of the pump chamber of the housing and through which the liquid hydrogen from the reservoir tank is suctioned into the pump chamber; a discharge port (for example, a discharge port 30*h*) that is disposed on a side of the motor chamber of the housing and through which the liquid hydrogen from the pump chamber is discharged; and a guiding flow line (for example, the motor chamber guiding flow line 30*f* that is disposed in the motor chamber outer wall 30*e* in series with the pump chamber guiding flow line 40*b* that is disposed in the pump chamber outer wall 40*a*) and through which the liquid hydrogen from the pump chamber is guided to the discharge port.

According to this configuration, the housing (the hydrogen gas in the motor chamber 3) is cooled by the liquid hydrogen that is guided through the guiding flow line.

A twelfth aspect of the present invention is the pump system in the eleventh aspect, in which the gas line includes a heat exchange line (for example, a third pipe section L14) attached to the pump unit, and the heat exchange line is disposed in such a way as to heat exchange between the hydrogen gas in the heat exchange line and the liquid hydrogen in the guiding flow line.

According to this configuration, the hydrogen gas in a third pipe section is always cooled while the pump unit is operating, and delivered to a buffer tank. Thus, an effect of the buffer tank in reducing pressure fluctuation improves.

A thirteenth aspect of the present invention is the pump system in any one of the seventh aspect to the twelfth aspect, further including a fan (for example, the fan 37) that causes the hydrogen gas to circulate between the motor chamber and the gas line, in which the housing includes a gas discharge port (for example, a gas discharge port 30*b*) through which the hydrogen gas introduced into the motor chamber is discharged to the gas line, and the gas line includes a third gas line (for example, the third pipe section L14) connected to the gas discharge port.

According to this configuration, the hydrogen gas in the motor chamber is cooled by the liquid hydrogen in the pump chamber and circulates without remaining in the motor chamber. As a result, the atmosphere of the hydrogen gas in the motor chamber and the buffer tank comes to equilibrium in terms of heat and pressure, and temperature in the motor chamber is maintained at a low temperature.

A fourteenth aspect of the present invention is the pump system in the thirteenth aspect, in which the fan is mounted on the rotation shaft and causes the hydrogen gas introduced through the gas introduction port to flow toward the gas discharge port.

According to this configuration, a special mechanism for accommodating and rotating the fan is not required, thereby facilitating flow of the hydrogen gas in the motor chamber.

A fifteenth aspect of the present invention is the pump system of the fourteenth aspect, in which the fan is mounted on an opposite end (for example, the rear end 31*b*) of the rotation shaft in the axial direction, the housing (for example, the motor chamber housing 30) includes a division wall (for example, the division wall 30*c*) that separates a first motor chamber (for example, the first motor chamber 36*a*) in which the motor is accommodated from a second motor chamber (for example, the second motor chamber 36*b*) in which the fan is accommodated, the division wall includes ventilating holes (for example, the ventilating holes 30*d*) that cause the first motor chamber to communicate with the second motor chamber, the gas introduction port opens toward the second motor chamber, and the gas discharge port opens toward the first motor chamber and is located on a side of the one end with respect to the motor in the axial direction.

According to this configuration, a circulation line in which the hydrogen gas circulates is constructed. The hydrogen gas in the motor chamber is cooled by the liquid hydrogen in the pump chamber and circulates in the circulation line, and thus, an atmosphere inside the circulation line comes to equilibrium in terms of heat and pressure.

A sixteenth aspect of the present invention is the pump system in the seventh aspect, further including: a purge gas line (for example, the purge gas line L2) connected to the gas line and a purge gas tank (for example, the second reservoir tank T2) in which purge gas (for example, helium gas He (G)) is stored, the purge gas being used for purging the hydrogen gas introduced into the motor chamber; and a switching unit (for example, the first valve V1 and the second valve V2) that switches gas to be introduced into the motor chamber between the purge gas and the hydrogen gas.

According to this configuration, in a situation where the pump unit is under maintenance or the like, the pump unit can be safely dismounted and disassembled without leaking hydrogen gas that is a combustible gas to an external environment.

A seventeenth aspect of the present invention is an operation method of a pump system (for example, the pump system 1, 1A, 1B, 1C, 1D, 1E, 1F) that is connected to a reservoir tank (for example, the first reservoir tank T1) in which liquid hydrogen (for example, the liquid hydrogen $H_2$ (L)) and hydrogen gas (for example, the hydrogen gas $H_2$ (G)) generated by vaporization of the liquid hydrogen are stored and that transfers the liquid hydrogen, in which the pump system includes a pump unit (for example, the pump unit 2, 2A) that suctions and discharges the liquid hydrogen and a gas line (for example, the gas line L1) connected to a gas-phase region (for example, the gas-phase region T1G) of the reservoir tank where the hydrogen gas is stored, the pump unit includes: a rotation shaft (for example, the rotation shaft 31); a motor (for example, the motor M) that causes the rotation shaft to rotate; an impeller (for example, the impeller 41) mounted on one end (for example, the front end 31*a*) of the rotation shaft in an axial direction of the rotation shaft; a housing (for example, the motor chamber housing 30, and the pump chamber housing 40) including a motor chamber (for example, the motor chamber 36) in which the motor is accommodated and a pump chamber (for example, the pump chamber 43) in which the impeller is accommodated; and a mechanical seal (for example, the mechanical seal 42) that is mounted on the rotation shaft and the housing and seals the motor chamber with respect to the pump chamber, and the motor includes a rotor (for example, the rotor 34) mounted on the rotation shaft and a stator (for example, the stator 35) that directly faces the rotor in a radial direction of the rotation shaft and causes the rotor to rotate, the method including an advance preparation step of performing a preparation for enabling the pump unit to transfer liquid and a step of discharging the liquid hydrogen from the pump chamber, in which the advance preparation step includes a step of introducing the liquid hydrogen into the pump chamber and a step of introducing the hydrogen gas through the gas line into the motor chamber.

According to this configuration, in the pump unit including the mechanical seal, no leakage of hydrogen can be achieved, and stable transferring of liquid hydrogen from low-speed rotation to high-speed rotation becomes possible.

REFERENCE SIGNS LIST

1 Pump system (First embodiment)
1A Pump system (First modification example of first embodiment)
1B Pump system (Second modification example of first embodiment)
1C Pump system (Second embodiment)
1D Pump system (First modification example of second embodiment)
1E Pump system (Second modification example of second embodiment)
1F Pump system (Third modification example of second embodiment)
2 Pump unit (First embodiment)
2A Pump unit (Second embodiment)
3 Motor section
30 Motor chamber housing
30*a* Gas introduction port
30*b* Gas discharge port
30*c* Division wall
30*d* Ventilating hole
30*e* Motor chamber outer wall
30*f* Motor chamber guiding flow line
31 Rotation shaft
31*a* Front end (One end)
31*b* Rear end (Opposite end)
34 Rotor
35 Stator
36 Motor chamber
36*a* First motor chamber
36*b* Second motor chamber
4 Pump section
40 Pump chamber housing
40*a* Pump chamber outer wall
40*b* Pump chamber guiding flow line
41 Impeller
42 Mechanical seal
43 Pump chamber
RM Reference abutment of pump chamber outer wall and motor chamber outer wall
HE Heat exchanger
L1 Gas line
L11 Pipe section
L12 First pipe section (First gas line)
L13 Second pipe section (Second gas line)
L14 Third pipe section (Third gas line)
L2 Purge gas line
L3 Suction flow line
L4 Discharge flow line
T1 First reservoir tank (Reservoir tank)
T1G Gas-phase region
T2 Second reservoir tank (Purge gas tank)
T3 Buffer tank (Buffer tank, Heat exchanger)
V1 First valve (Open/close valve, Switching unit)
V3 Third valve (Switching unit)

The invention claimed is:

1. A pump unit comprising:
a rotation shaft;
a motor configured to cause the rotation shaft to rotate;
an impeller mounted on the rotation shaft;
a housing including a motor chamber housing that defines a motor chamber in which the motor is accommodated and a motor pump chamber housing that defines a pump chamber in which the impeller is accommodated; and
a mechanical seal mounted on the rotation shaft and the housing in an arrangement for sealing the motor chamber with respect to the pump chamber,
wherein
the rotation shaft extends into the motor chamber and into the pump chamber;
the motor includes:
a rotor mounted on the rotation shaft, and
a stator that directly faces the rotor in a radial direction of the rotation shaft and is configured to cause the rotor to rotate;
the motor chamber housing includes:
a motor chamber outer wall that separates the motor chamber from an environment outside the housing, and
a gas introduction port, disposed in the motor chamber outer wall, and configured to allow introduction into the motor chamber of hydrogen gas;
the pump chamber housing includes a pump chamber outer wall that separates the pump chamber from the environment outside the housing;
the housing includes:
a suction port, disposed on a side of the pump chamber outer wall, and configured to allow, during rotation of the impeller, liquid hydrogen to be suctioned into the pump chamber,
a discharge port, disposed on a side of the motor chamber outer wall, and configured to allow the liquid hydrogen to be discharged, and
a guiding flow line configured to guide a discharge flow of the liquid hydrogen from
the pump chamber to the discharge port;
the guiding flow line includes:
a pump chamber guiding flow line that is disposed in the pump chamber outer wall and extends from the pump chamber to a pump chamber guiding flow line termination, and
a motor chamber guiding flow line that is disposed in the motor chamber outer wall and extends from the pump chamber guiding line termination to the discharge port;
the gas introduction port is configured to be connectable to an external gas line capable of extending to hydrogen gas in a reservoir tank; and
the suction port is configured to be connectable to an external suction flow line capable of extending to liquid hydrogen in the reservoir tank.

2. The pump unit according to claim 1, wherein the motor chamber guiding flow line is disposed in the motor chamber outer wall in such a configuration as to provide, via the motor chamber outer wall, heat exchange between the hydrogen gas in the motor chamber and the liquid hydrogen in the motor chamber guiding flow line.

3. The pump unit according to claim 1, further comprising a fan disposed in the motor chamber, wherein the housing includes a gas discharge port configured to allow the hydrogen gas introduced into the motor chamber to be discharged to the external gas line, and the fan is configured to cause the hydrogen gas introduced into the motor chamber through the gas introduction port to flow toward the gas discharge port.

4. The pump unit according to claim 3, wherein the mechanical seal is arranged relative to the pump chamber and the rotation shaft such that leaks of liquid hydrogen from the pump chamber enter into the motor chamber, and the fan is further configured to cause flow toward the gas discharge port of the hydrogen gas introduced into the motor chamber through the gas introduction port and of hydrogen gas formed by vaporization in the motor chamber of liquid hydrogen that has leaked by the mechanical seal into the motor chamber.

5. The pump unit according to claim 1, further comprising at least two rotary bearings, mounted to the motor chamber housing and aligned to a common rotation axis, wherein the rotation shaft, rotatably supported by the at least two rotary bearings and extending in the motor chamber and into the pump chamber in an axial direction along the common rotation axis; and the motor chamber housing configured to allow a lubricating flow to the at least two rotary bearings of the hydrogen gas introduced into the motor chamber.

* * * * *